US008829434B2

(12) United States Patent
Yasuda et al.

(10) Patent No.: US 8,829,434 B2
(45) Date of Patent: Sep. 9, 2014

(54) MASS SPECTROMETER AND MASS SPECTROMETRY METHOD

(75) Inventors: Hiroyuki Yasuda, Hitachinaka (JP); Shinji Yoshioka, Hitachinaka (JP)

(73) Assignee: Hitachi High-Technologies Corporation, Tokyo (JP)

( * ) Notice: Subject to any disclaimer, the term of this patent is extended or adjusted under 35 U.S.C. 154(b) by 0 days.

(21) Appl. No.: 13/885,435

(22) PCT Filed: Nov. 17, 2011

(86) PCT No.: PCT/JP2011/076559

§ 371 (c)(1), (2), (4) Date: May 15, 2013

(87) PCT Pub. No.: WO2012/067195

PCT Pub. Date: May 24, 2012

(65) Prior Publication Data

US 2013/0228682 A1 Sep. 5, 2013

(30) Foreign Application Priority Data

Nov. 19, 2010 (JP) ..... 2010-259230

(51) Int. Cl.

| | |
|---|---|
| ***H01J 49/14*** | (2006.01) |
| ***H01J 49/00*** | (2006.01) |
| ***H01J 49/42*** | (2006.01) |
| ***H01J 49/06*** | (2006.01) |

(52) U.S. Cl.

CPC ..... *H01J 49/14* (2013.01); *H01J 49/4255* (2013.01); *H01J 49/063* (2013.01); *H01J 49/0045* (2013.01); *H01J 49/0031* (2013.01)

USPC ..... 250/292; 250/281; 250/282

(58) Field of Classification Search

USPC ..... 250/281, 282, 292

See application file for complete search history.

(56) References Cited

U.S. PATENT DOCUMENTS

| | | | | |
|---|---|---|---|---|
| 4,700,069 | A | 10/1987 | Ino et al. | |
| 5,847,386 | A * | 12/1998 | Thomson et al. | 250/288 |
| 6,111,250 | A * | 8/2000 | Thomson et al. | 250/282 |
| 6,909,089 | B2 * | 6/2005 | Londry et al. | 250/282 |
| 6,987,264 | B1 * | 1/2006 | Whitehouse et al. | 250/292 |

(Continued)

FOREIGN PATENT DOCUMENTS

| | | |
|---|---|---|
| JP | 60257055 A | 12/1985 |
| JP | 11-510946 A | 9/1999 |

(Continued)

*Primary Examiner* — David A Vanore

(74) *Attorney, Agent, or Firm* — Mattingly & Malur, PC

(57) ABSTRACT

A mass spectrometer is provided including: a collision chamber of generating fragment ions by superimposingly applying an AC voltage and a first DC voltage between linear multipolar electrodes, and accelerating the fragment ions by applying a second DC voltage between a front stage electrode and a later stage electrode; a mass spectrometer unit of carrying out mass separation of the fragment ions; and a control unit of determining the second DC voltage based on the mass-to-charge ratios such that the rates of the fragment ions in the collision chamber become equal regardless of the mass-to-charge ratios. Herein, the control unit increases the second DC voltage as the mass-to-charge ratios selected by the mass spectrometer unit become larger. This allows the mass window to be wider even when a DC electric field is generated in order to solve a crosstalk drawback, in the movement direction of the molecular ions.

20 Claims, 13 Drawing Sheets

(56) References Cited

U.S. PATENT DOCUMENTS

| | | | | |
|---|---|---|---|---|
| 7,084,398 | B2 * | 8/2006 | Loboda et al. | 250/292 |
| 7,285,774 | B2 * | 10/2007 | Guevremont | 250/290 |
| 7,312,442 | B2 * | 12/2007 | Hansen | 250/282 |
| 7,405,401 | B2 * | 7/2008 | Hoyes | 250/292 |
| 7,423,262 | B2 * | 9/2008 | Mordehai et al. | 250/292 |
| 7,459,693 | B2 * | 12/2008 | Park et al. | 250/423 R |
| 7,507,955 | B2 * | 3/2009 | Crawford et al. | 250/292 |
| 7,569,811 | B2 * | 8/2009 | Javahery et al. | 250/282 |
| 7,569,814 | B2 * | 8/2009 | Hashimoto et al. | 250/282 |
| 7,638,766 | B1 * | 12/2009 | Schoen | 250/292 |
| 7,786,435 | B2 * | 8/2010 | Whitehouse et al. | 250/292 |
| 7,932,488 | B2 * | 4/2011 | Javahery et al. | 250/282 |
| 8,017,909 | B2 * | 9/2011 | Makarov et al. | 250/292 |
| 8,212,208 | B2 * | 7/2012 | Green et al. | 250/283 |
| 8,334,507 | B1 * | 12/2012 | Whitehouse et al. | 250/292 |
| 8,350,212 | B2 * | 1/2013 | Covey et al. | 250/281 |
| 8,492,713 | B2 * | 7/2013 | Steiner et al. | 250/290 |
| 8,541,737 | B2 * | 9/2013 | Ibrahim et al. | 250/282 |
| 8,546,754 | B2 * | 10/2013 | Makarov et al. | 250/292 |
| 2007/0164213 | A1 * | 7/2007 | Javahery et al. | 250/292 |
| 2009/0020695 | A1 | 1/2009 | Satake et al. | |
| 2010/0065737 | A1 * | 3/2010 | Bateman et al. | 250/283 |
| 2012/0267526 | A1 * | 10/2012 | Green | 250/290 |
| 2013/0240726 | A1 * | 9/2013 | Hasegawa et al. | 250/288 |

FOREIGN PATENT DOCUMENTS

| | | | |
|---|---|---|---|
| JP | 2006-073390 | A | 3/2006 |
| JP | 2007-095702 | A | 4/2007 |
| JP | 2008-523554 | A | 7/2008 |
| JP | 2009-026465 | A | 2/2009 |
| WO | 97/07530 | A1 | 2/1997 |
| WO | 2010/044247 | A1 | 4/2010 |

* cited by examiner

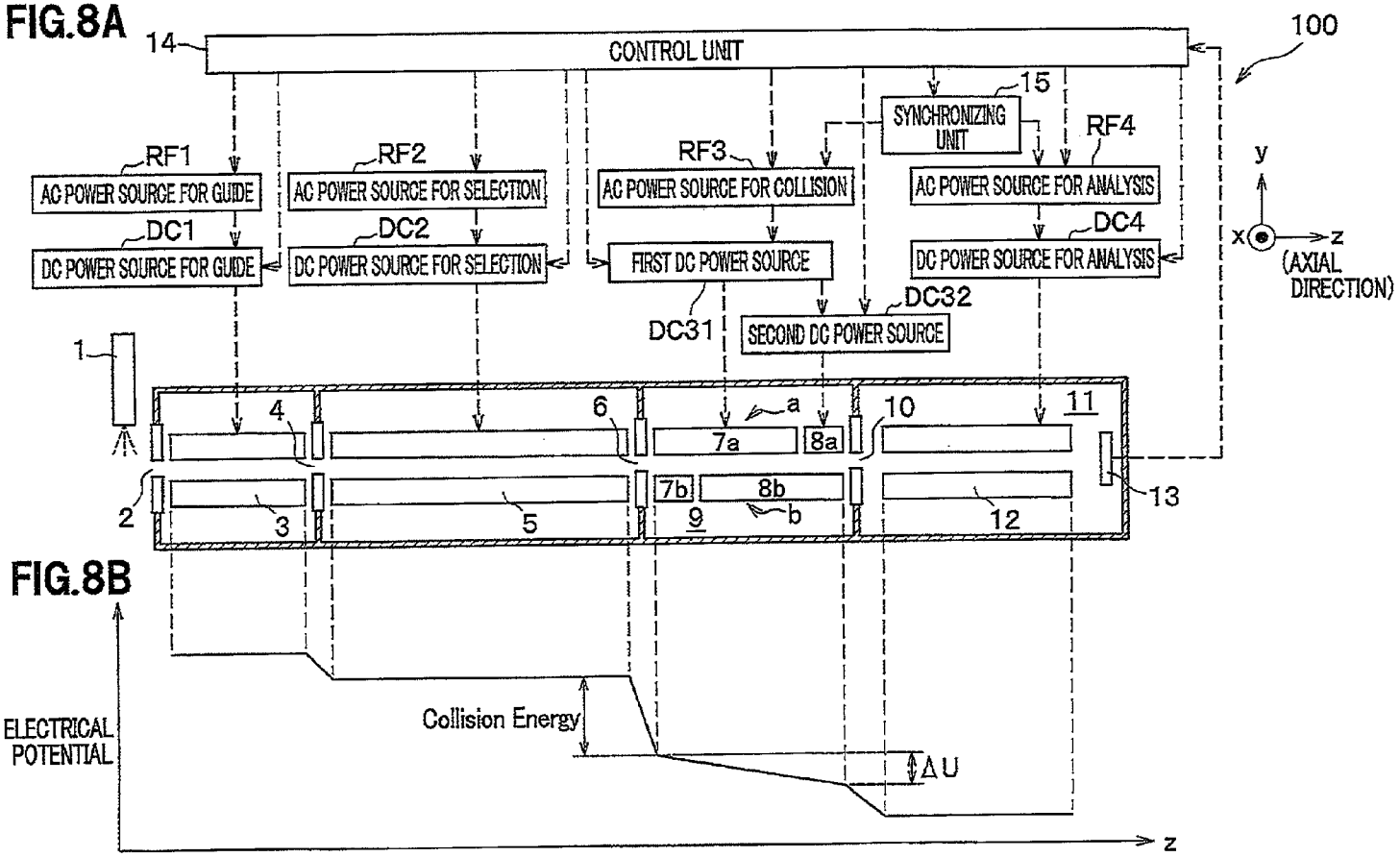
100
CONTROL UNIT
14
SYNCHRONIZING UNIT
15
AC POWER SOURCE FOR ANALYSIS
RF4
DC POWER SOURCE FOR ANALYSIS
DC4
SECOND DC POWER SOURCE
DC32
AC POWER SOURCE FOR COLLISION
RF3
FIRST DC POWER SOURCE
DC31
AC POWER SOURCE FOR SELECTION
RF2
DC POWER SOURCE FOR SELECTION
DC2
AC POWER SOURCE FOR GUIDE
RF1
DC POWER SOURCE FOR GUIDE
DC1
y
x
z
(AXIAL DIRECTION)
1
2
3
4
5
6
7a
7b
8a
8b
9
10
11
12
13
a
b
FIG.8A
ΔU
Collision Energy
ELECTRICAL POTENTIAL
z
FIG.8B

FIRST MEASUREMENT
SECOND MEASUREMENT
THIRD MEASUREMENT
DATA COLLECTION TIME
TIME

MASS m
TIME

ΔU
TIME

RF4
TIME

RF3
TIME

MASS SPECTROMETER AND MASS SPECTROMETRY METHOD

FIELD OF THE INVENTION

The present invention relates to a mass spectrometer and a mass spectrometry method.

DESCRIPTION OF THE RELATED ART

Mass spectrometers are devices of adding electric charges to sample molecules for ionization, separating the generated ions based on the mass-to-charge ratios using an electric field or a magnetic field, and measuring the amount of the ions as current values via a detector. The mass spectrometer is higher sensitive and more excellent in quantitative analysis and identification performance of sample molecules than conventional analyzers. Recently, in the field of life science, analyses of a peptide and a metabolite have been paid much attention instead of a genome analysis. Hereby, effectiveness of the mass spectrometer has been reevaluated, due to the high sensitive and excellent performance in identification and quantitative determination of such a peptide and a metabolite.

In mass spectrometry, when the composition of the sample molecule is complex, especially when there are many impurities derived from a solvent or environment in a mass spectrum with mass-to-charge ratios of 400 or less, a $MS^n$ analysis is carried out in order to distinguish a target component from impurities.

The $MS^n$ analysis is a method for measuring fragment ions generated from a molecule ion via breaking bonds of the molecule. The method includes the steps of taking molecule ions formed via ionizing sample molecules into a mass spectrometer with converging the ions into a beam; selecting molecule ions having a specific mass-to-charge ratio among the ions thus formed (or ion selection), and having neutral molecules collide against the selected molecule ions (or target ions), thereby to break a part of bonds in the target ions (or CID: Collision Induced Dissociation).

The collision induced dissociation in a $MS^n$ analysis has a drawback. That is, when the neutral molecules collide against the target ions, associated with decrease in the kinetic energy of fragment ions, decrease in ion velocities leads to broader distribution of the ion velocities. Accordingly, a so-called crosstalk may occur in a $MS^n$ analysis in which previous measurement data influences the following measurement when a plurality of sample molecules are measured. If the crosstalk occurs, this causes such drawbacks as the display of unnecessary structural data and decrease in quantitative accuracy. In order to solve the crosstalk drawback, proposed is the generation of an axial electric field in a collision chamber which causes collision induced dissociation (refer to Patent Documents 1 and 2).

According to Patent Documents 1 and 2, generation of a DC (direct current) electric field (or acceleration voltage) in the movement direction of the fragment ions (axial direction) additionally accelerates the fragment ions. This allows a retention time of each fragment ion in the collision chamber to be shortened, where the collision induced dissociation is carried out.

PRIOR TECHNICAL DOCUMENT

Patent Document

Patent Document 1:

Japanese Unexamined Patent Application Publication No. 2007-95702

Patent Document 2:

Japanese Unexamined Patent Application Publication No. Hei 11-510946

SUMMARY OF THE INVENTION

Problems to be Solved by the Invention

On the other hand, according to Patent Documents 1 and 2, when a DC electric field (acceleration voltage) is generated in the movement direction of molecule ions (or axial direction), an electrical potential difference (or acceleration voltage) also arises in the orthogonal direction with respect to the movement direction of the molecule ions. Therefore, the increase in the DC electric field in the movement direction increases the electrical potential difference (or acceleration voltage) in the orthogonal direction. This may allow the molecule ions to be lost exceeding a square well potential in which the molecule ions have been converged.

That is, in order to solve the crosstalk drawback as mentioned above, if a DC electric field (acceleration voltage) is generated in the movement direction of the molecule ions, immeasurable molecule ions are formed, resulting in another drawback that a so-called mass window becomes narrow.

Hence, an object of the present invention is to provide a mass spectrometer and a mass spectrometry method, having a large mass window, even if a DC electric field is generated in the movement direction of the molecule ions in order to solve the crosstalk drawback.

Means for Solving the Problem

The present invention is directed to a mass spectrometer comprising: a collision chamber which includes linear multipolar electrodes, and accelerates fragment ions in a direction along the linear multipolar electrodes by superimposingly applying a collision AC (alternating current) voltage and a first DC voltage between the linear multipolar electrodes, having a molecule ion collide with a neutral molecule to cause collision induced dissociation of the molecule ion and to generate the fragment ions, and applying a second DC voltage between a front stage electrode and a later stage electrode that are arranged as being divided from each linear multipolar electrode; a mass spectroscopy unit which carries out mass separation of the fragment ions accelerated in the collision chamber, based on mass-to-charge ratios thereof; and a control unit which determines the second DC voltage based on the mass-to-charge ratios of the fragment ions to be selected in the mass spectroscopy unit such that a velocity of each fragment ion in the collision chamber comes to be equal regardless of the mass-to-charge ratio of each fragment ion.

Further, the present invention is also directed to a mass spectrometry method using the above mentioned mass spectrometer.

Effect of the Invention

According to the present invention, it is possible to provide a mass spectrometer and a mass spectrometry method, having a large mass window, even if a DC electric field is generated in a movement direction of molecule ions in order to solve a crosstalk drawback.

BRIEF DESCRIPTION OF THE DRAWINGS

FIG. 8A is a block diagram showing a control unit, a synchronizing unit and power sources of the mass spectrometer according to the second embodiment of the present invention.

FIG. 8B is a graphic diagram showing electrical potential along an axial direction of the mass spectrometer.

DETAILED DESCRIPTION OF THE INVENTION

Figure 1:
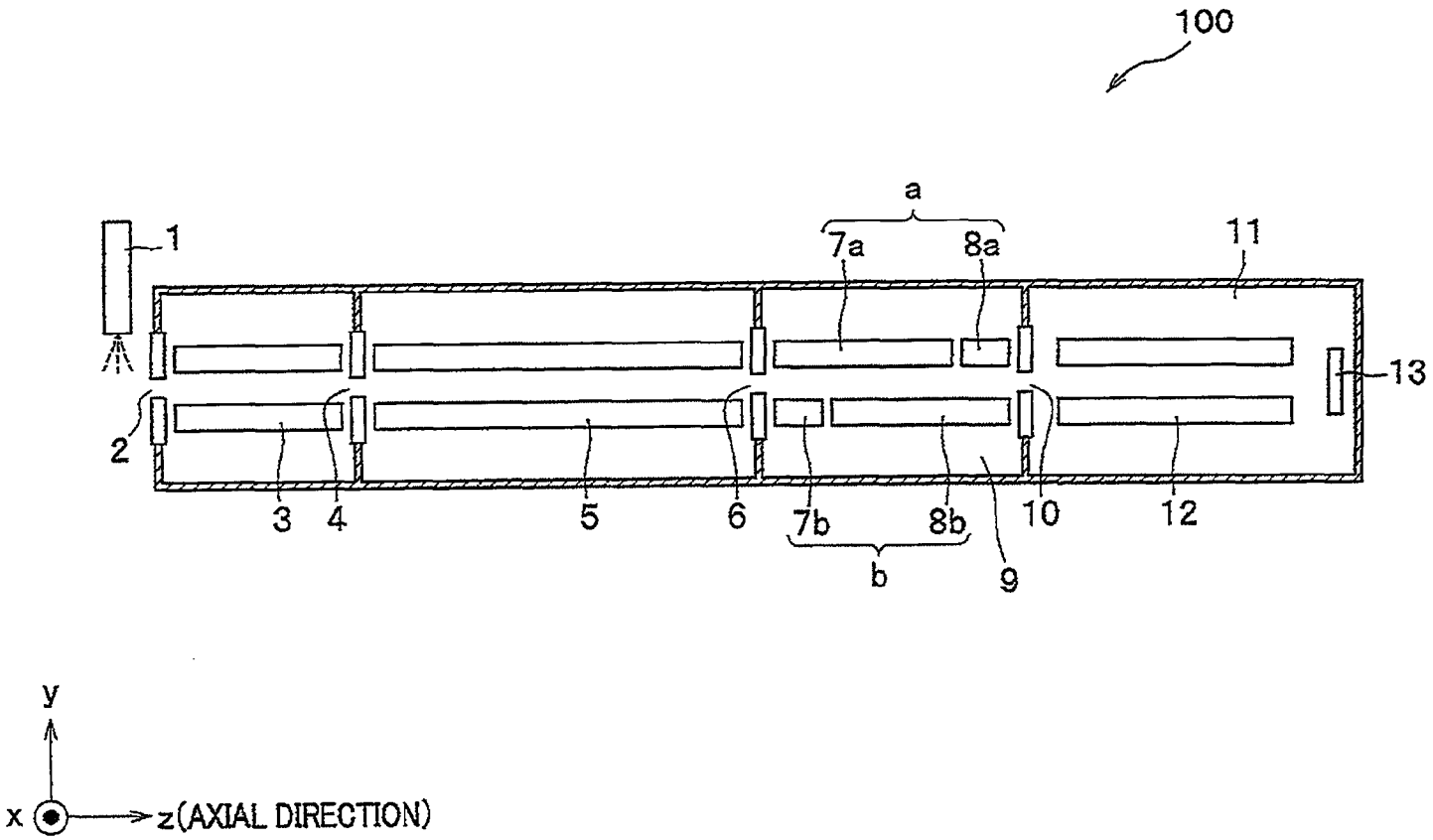
FIG. 1 is a block diagram of a mass spectrometer according to a first embodiment of the present invention.

Next, embodiments of the present invention will be described in detail with reference to the drawings as appropriate. It should be noted that, in each figure, common parts are assigned to the same reference numerals and duplicate descriptions thereof are omitted.

First Embodiment

FIG. 1 shows a block diagram of a mass spectrometer 100 according to the first embodiment of the present invention. In the mass spectrometer 100 of the first embodiment, a triple quadrupole mass spectrometer (QMS: Quadrupole Mass Spectrometer) is explained as an example.

An ion source unit 1 is provided in the mass spectrometer 100. Several kilovolts of DC voltage are applied to the ion source unit 1, which ionizes sample molecules to generate molecule ions. The molecule ions electrified in positive or negative pass through a pore 2 with about 0.2-0.8 mm in diameter and are introduced into the inside of a body of the mass spectrometer 100 under a reduced pressure.

An ion guide unit (or first stage quadrupole (or first stage linear quadrupolar electrode)) 3 is provided in a rear stage of the pore 2. The ion guide unit 3 is provided for efficiently transporting the molecule ions to the selection unit 5. The ion guide unit 3 has four pole-shaped electrodes having a cylindrical shape or hyperboloid (or linear quadrupolar electrode (or linear multipolar electrode)). It should be noted that the number of the electrodes (or linear multipolar electrode) may be 6, 8, or more. By applying a high frequency voltage to the linear quadrupolar electrodes in the ion guide unit 3, a quadrupole electric field is formed between the linear quadrupolar electrodes to produce a square well potential, and it is possible to cause the molecule ions to be converged between the linear quadrupolar electrodes for transportation. That is, the linear quadrupolar electrodes in the ion guide unit 3 have a transportation function and a convergence/guidance function of the molecule ions.

The pore 4 is provided in a subsequent stage of the ion guide unit 3. The pore 4 is provided for performing differential pumping the front stage (ion guide unit 3 side) while maintaining the later stage (selection unit 5 side) in high vacuum.

The selection unit (second stage quadrupole (second stage linear quadrupolar electrode)) 5 is provided in a subsequent stage of the pore 4. The selection unit 5 has four pole-shaped electrodes (linear quadrupolar electrode (linear multipolar electrode)) having a cylindrical shape or hyperboloid. By applying high frequency voltage to the linear quadrupolar electrode of the selection unit 5, a quadrupole electric field is formed between the linear quadrupolar electrodes to form a square well potential, and it is possible to cause the molecule ions to be converged between the linear quadrupolar electrodes for transportation. Furthermore, when superimposing the DC voltage onto the linear quadrupolar electrode to which high frequency voltage is applied such that the ratio of the high frequency voltage to the DC voltage is constant, the molecule ions of a specific mass-to-charge ratio can be transmitted without transmitting the molecule ions having other mass-to-charge ratio. That is, the linear quadrupolar electrode also has an ion selection function of the molecule ions. It should be noted that a mass-to-charge ratio of the molecule ions that is the target of the structure analysis, that is, so-called target ions, is selected for the specific mass-to-charge ratio. Such target ions are subjected to collision induced dissociation in the collision chamber 9.

The pore 6 is provided in a subsequent stage of the selection unit 5. The collision chamber 9 is provided in a subsequent stage of the pore 6. The target ions pass through the pore 6 and are introduced into the collision chamber 9. Inside of the collision chamber 9 is maintained to a pressure of about hundreds of mmPa (several millimeter Torr) by introducing neutral molecules, such as helium (He) and nitrogen ($N_2$). The collision chamber 9 has four pole-shaped electrodes (linear quadrupolar electrode (linear multipolar electrode)) a and b (c and d are not illustrated) having a cylindrical shape or hyperboloid. It should be noted that the number of the electrodes (linear quadrupolar electrode) a and b (c and d are not illustrated) may be 6, 8, or more. By applying high frequency voltage to the linear quadrupolar electrodes a and b (c and d are not illustrated), it is possible to form a quadrupole electric field between the linear quadrupolar electrodes a and b (c and d are not illustrated), form a square well potential, and converge the target ions between the linear quadrupolar electrodes a and b (c and d are not illustrated). Furthermore, when superimposing a DC voltage on the linear quadrupolar electrodes a and b (c and d are not illustrated), cleavage (collision induced dissociation) of the target ions can be carried out and fragment ions can be generated. The target ions are subjected to collision induced dissociation (cleavage) due to the electrical potential difference between the DC voltage of the linear quadrupolar electrode of the selection unit 5 and the DC voltage of the linear quadrupolar electrode of the collision chamber 9. That is, the linear quadrupolar electrodes a and b (c and d are not illustrated) have a dissociation function of the target ions (molecule ions).

The pore 10 is provided in a subsequent stage of the collision chamber 9. The pore 10 is provided in a vacuum barrier which divides the collision chamber 9 and the mass spectroscopy unit 11. A DC voltage can be applied to the vacuum barrier so as to function as an electrode. The fragment ions discharged from the collision chamber 9 pass through the pore 10 and is introduced into the mass spectroscopy unit 11.

The mass spectroscopy unit 11 has four pole-shaped electrode (fourth stage quadrupole (fourth stage linear quadrupolar electrode)) 12 having a cylindrical shape or hyperboloid, and a detector 13. By applying high frequency voltage to the linear quadrupolar electrode 12, the quadrupole electric field can be formed between the linear quadrupolar electrodes 12, a square well potential can be formed, and fragment ions can be converged between the linear quadrupolar electrodes 12. Furthermore, when DC voltage is superimposed on the linear quadrupolar electrode 12 such that the ratio of high frequency voltage to the DC voltage is constant, the fragment ions of a specific mass-to-charge ratio can be transmitted without transmitting fragment ions having other mass-to-charge ratio. That is, the linear quadrupolar electrode 12 has a selection function (filtering function) of the fragment ions.

Then, the linear quadrupolar electrode 12 transports the fragment ions of the specific mass-to-charge ratio to the detector 13. The detector 13 can measure the amount of the fragment ions.

Figures 2A, 2B:
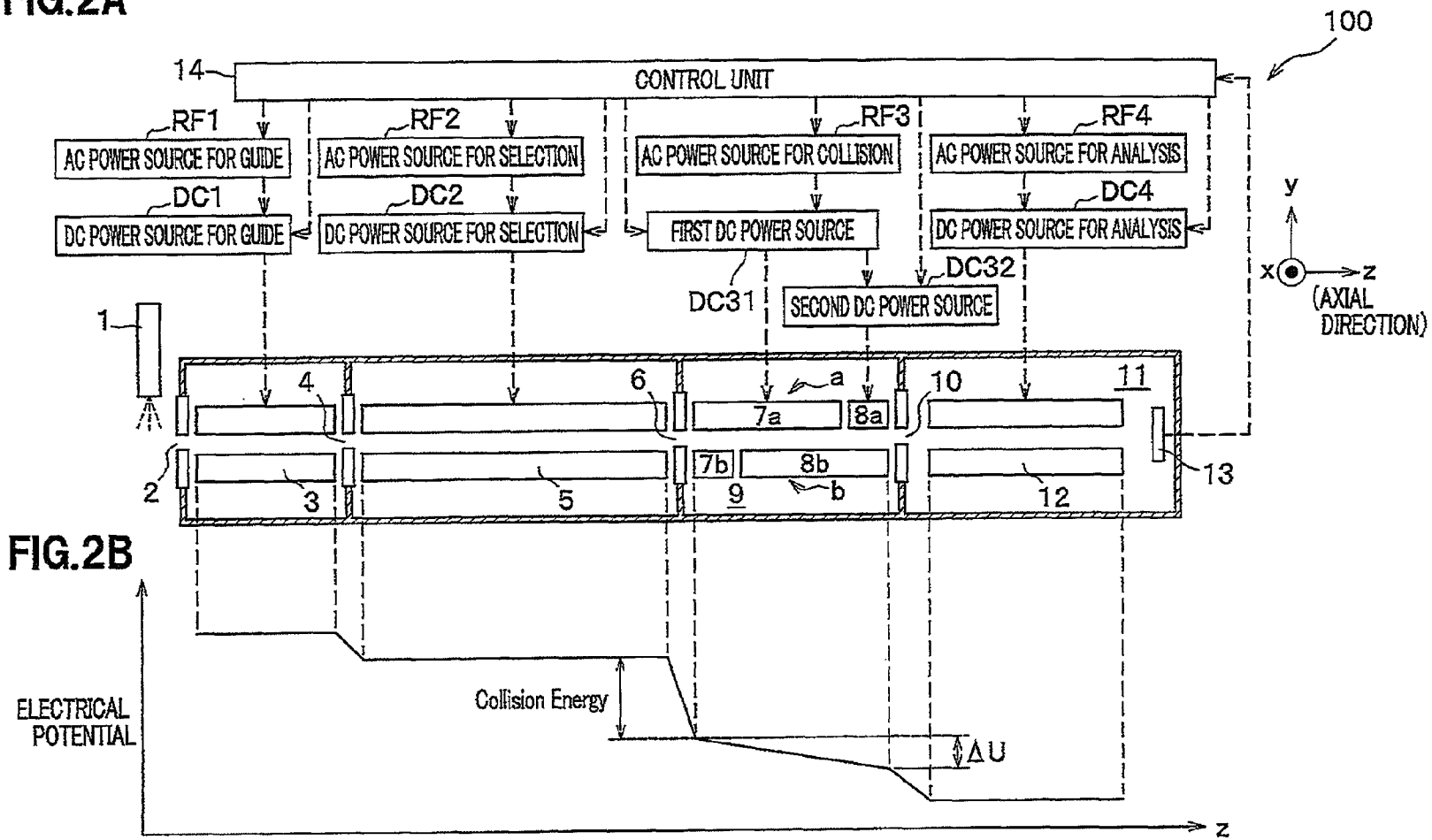
FIG. 2A is a block diagram showing a control unit and power sources of the mass spectrometer according to the first embodiment of the present invention.
FIG. 2B is a graphic diagram showing electrical potential along an axial direction of the mass spectrometer.

FIG. 2A is a block diagram showing the control unit 14 and power sources RF1, RF2, RF3, RF4, DC1, DC2, DC31, DC32 and DC4 of the mass spectrometer 100 according to the first embodiment of the present invention; and FIG. 2B shows electrical potential distribution along the axial direction of the mass spectrometer 100. It should be noted that, for ease of description, the reference labels RF1 or the like in the power sources RF1, RF2, RF3, RF4, DC1, DC2, DC31, DC32 and DC4 represents the voltage that the power sources RF1, RF2, RF3, RF4, DC1, DC2, DC31, DC32 and DC4 output. Specifically, the AC power source for guide RF1 outputs the AC voltage for guide RF1.

The AC power source for guide RF1 is connected to the ion guide unit (first stage quadrupole (first stage linear quadrupolar electrode)) 3 and the AC voltage for guide (high frequency voltage) RF1 can be applied to the ion guide unit 3. In addition, the DC power source for guide DC1 is connected to the ion guide unit 3 and the DC voltage for guide DC1 can be applied to the ion guide unit 3. By the control unit 14 controlling application of the AC voltage for guide RF1 and the DC voltage for guide DC1 to the ion guide unit 3, the ion guide unit 3 can cause the molecule ions to be converged and transport to the selection unit 5.

An AC power source for selection RF2 is connected to the selection unit (second stage quadrupole (second stage linear quadrupolar electrode)) 5 and the AC voltage for selection (high frequency voltage) RF2 can be applied to the selection unit 5. In addition, the DC power source for selection DC2 is connected to the selection unit 5 and the DC voltage for selection DC2 can be applied to the selection unit 5. When the control unit 14 controls the superimposing application of the AC voltage for selection (high frequency voltage) RF2 and the DC voltage for selection DC2 such that the voltage ratio of them is constant, it is possible to transmit the molecule ions of a specific mass-to-charge ratio from the selection unit 5 without transmitting the molecule ions having other mass-to-charge ratio.

The AC power source for collision RF3 is connected to the linear multipolar electrodes (third stage linear quadrupolar electrode) a and b (c and d are not illustrated) of the collision chamber 9 and the AC voltage for collision (high frequency voltage) RF3 can be applied to the linear multipolar electrodes a and b. In addition, the first DC power source DC31 and the second DC power source DC32 are connected to the linear multipolar electrodes (third stage linear quadrupolar electrode) a and b (c and d are not illustrated) and the first DC voltage DC31 and the second DC voltage DC32 can be applied to the linear multipolar electrodes a and b. The control unit 14 can converge the target ions between the linear quadrupolar electrodes a and b (c and d are not illustrated) by carrying out control that applies the AC voltage for collision (high frequency voltage) RF3 to the linear quadrupolar electrodes a and b (c and d are not illustrated). Furthermore, when the control unit 14 superimposes the first DC voltage DC31 on the linear quadrupolar electrodes a and b (c and d are not illustrated), fragment ions can be generated by collision induced dissociation of the target ions according to the electrical potential difference (or collision energy) between the DC voltage for selection DC2 and the first DC voltage DC31. By the control unit 14 controlling the second DC voltage DC32 (acceleration voltage $\Delta U$) applied among the front stage electrodes 7*a* and 7*b* (7*c* and 7*d* are not illustrated) and the later stage electrodes 8*a* and 8*b* (8*c* and 8*d* are not illustrated), the fragment ions can be accelerated in the axial direction (z-axis direction).

The AC power source for analysis RF4 is connected to the fourth stage quadrupole (fourth stage linear quadrupolar electrode) 12 of the mass spectroscopy unit 11 and the AC voltage for analysis (high frequency voltage) RF4 can be applied to the fourth stage quadrupole 12. In addition, the analysis DC power source DC4 is connected to the fourth stage linear quadrupolar electrode 12 and the DC voltage for analysis DC4 can be applied to the fourth stage linear quadrupolar electrode 12. When the control unit 14 controls the superimposing application of the AC voltage for analysis (high frequency voltage) RF4 and the DC voltage for analysis DC4 such that the voltage ratio between them is constant, the fragment ions of specific mass-to-charge ratio can be transmitted to the detector 13 without transmitting fragment ions having other mass-to-charge ratio. The amount of fragment ions for each mass-to-charge ratio detected with the detector 13 is transmitted to the control unit 14.

Then, if the control unit 14 carries out voltage scan of the AC voltage for analysis (high frequency voltage) RF4 and the DC voltage for analysis DC4, it is possible to scan the mass-to-charge ratio of the fragment ions that can be transmitted to the detector 13 such that the ions sequentially distribute from ions having small mass-to-charge ratio to ions having large mass-to-charge ratio. Thereby, it is possible to obtain mass spectrum. The mass spectrometer 100 which adopts such a quadrupolar mass spectrometer has a feature of high quantitative determination capability since sequential measurement like $MS^n$ analysis can be performed and the dynamic range of the detector is wide.

In $MS^n$ analysis, the molecule ions of specific mass-to-charge ratio are selected (ion selection), collision induced dissociation of the selected molecule ions (target ions) is carried out, and the fragment ions are generated and measured. In $MS^n$ analysis, series of operation of the ion selection and the collision induced dissociation can be carried out from one time to a plurality of times. The name of the $MS^n$ analysis changes according to the number of repetitions of a series of operations of the ion selection and the collision induced dissociation. When repeating two times, it is called $MS^2$ analysis, and when repeating three times, it is called $MS^3$ analysis. Bonding among atoms in the sample molecules differs in bonding energy according to the structure and kind of the bonding, and is broken from the part where bonding energy is low in the collision induced dissociation. The structure of the molecule ions can be known by repeating the collision induced dissociation and generating known fragment ions. Furthermore, since the fragment ions are selected as target ions and are cleaved, noise is small with respect to the mass-to-charge ratio of the fragment ions after cleavage and therefore it is possible to increase the signal strength to noise ratio (S/N ratio).

Figure 3:
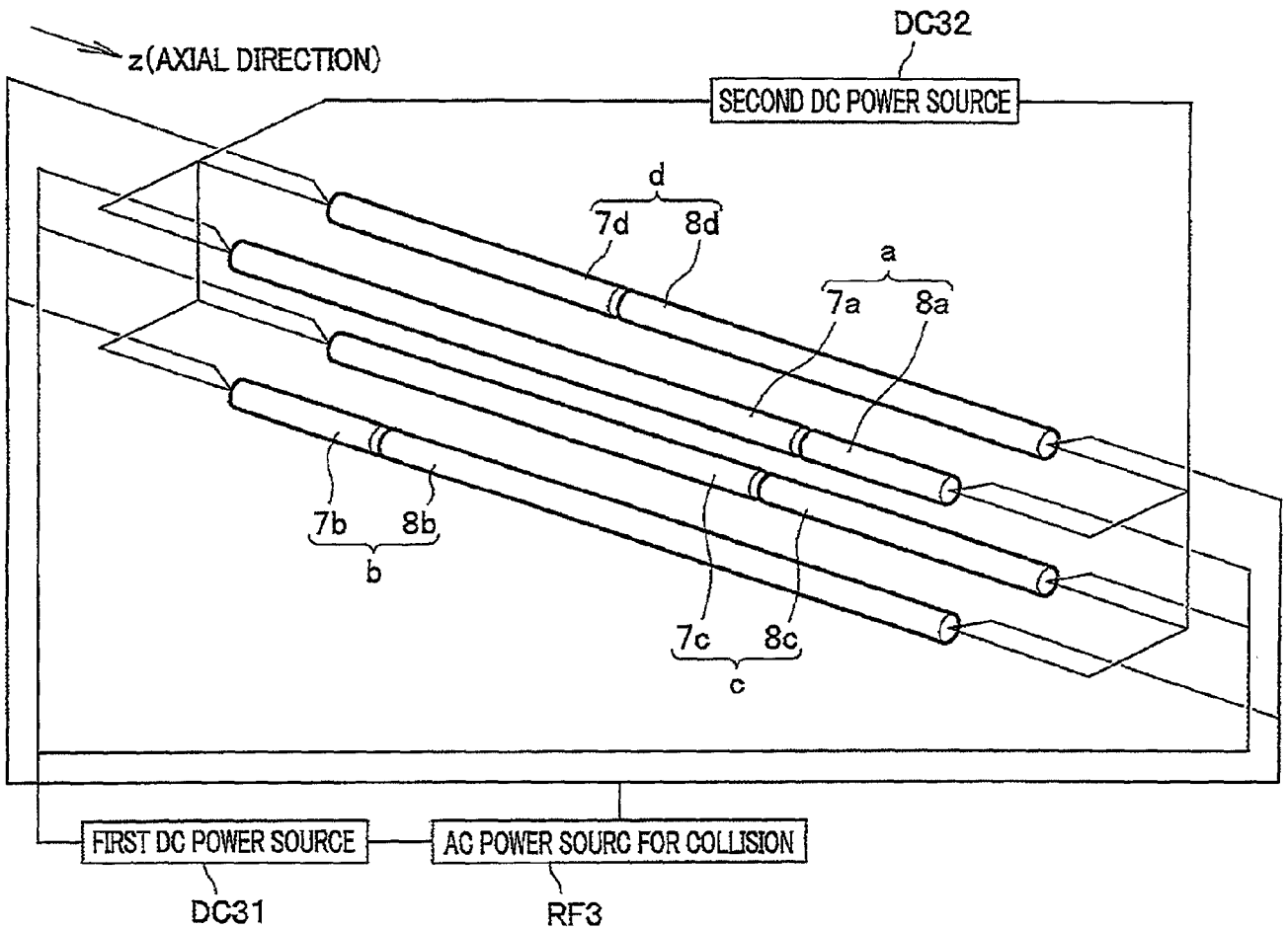
FIG. 3 is a connection diagram of a linear multipolar electrode provided in the collision chamber of the mass spectrometer according to the first embodiment of the present invention.

FIG. 3 shows a connection diagram of linear multipolar electrodes (third stage linear quadrupolar electrode) a, b, c and d provided in the collision chamber 9 of the mass spectrometer 100 according to the first embodiment of the present invention. The linear quadrupolar electrodes a, b, c and d are arranged in parallel with each other along the axial direction. When seen in a cross-sectional view in a plane perpendicular to the axial direction, the linear quadrupolar electrodes a, b, c and d are arranged at positions of angles of a square (rectangle). The linear quadrupolar electrodes a and c are arranged on one diagonal line of the square and the linear quadrupolar electrodes b and d are arranged on the other diagonal line of the square.

The linear quadrupolar electrodes a, b, c and d are respectively divided into the front stage electrodes 7*a*, 7*b*, 7*c* and 7*d* and the later stage electrodes 8*a*, 8*b*, 8*c* and 8*d* and are spaced apart with each other. The length of the front stage electrodes 7*a*, 7*b*, 7*c* and 7*d* in the axial direction differs with each other. In addition, the length of the later stage electrodes 8*a* 8*b*, 8*c* and 8*d* in the axial direction differs with each other. However, the sum of the length of the front stage electrode 7*a* and the later stage electrode 8*a*, which are a pair, in the axial direction; the sum of the length of the front stage electrode 7*b*, which are a pair and the later stage electrode 8*b*, which are a pair, in the axial direction; the sum of the length of the front stage electrode 7*c* and the later stage electrode 8*c*, which are a pair, in the axial direction; and the sum of the length of the front stage electrode 7*d* and the later stage electrode 8*d*, which are a pair, in the axial direction are equal.

A second DC power source DC32 is connected among the front stage electrodes 7*a*, 7*b*, 7*c* and 7*d* and the later stage electrodes 8*a*, 8*b*, 8*c* and 8*d*. Fragment ions can be accelerated in the axial direction (z-axis direction) by applying the second DC voltage DC32 (acceleration voltage ΔU) among the front stage electrodes 7*a*, 7*b*, 7*c* and 7*d* and the later stage electrodes 8*a*, 8*b*, 8*c* and 8*d*.

An AC power source for collision RF3 and a first DC power source DC31 are connected between the linear quadrupolar electrodes a and c (front stage electrodes 7*a* and 7*c* and later stage electrodes 8*a* and 8*c*) and the linear quadrupolar electrodes b and d (front stage electrodes 7*b* and 7*d* and later stage electrodes 8*b* and 8*d*). By the AC voltage for collision RF3 being applied between the linear quadrupolar electrodes a and c (front stage electrodes 7*a* and 7*c* and later stage electrodes 8*a* and 8*c*) and the linear quadrupolar electrodes b and d (front stage electrodes 7*b* and 7*d* and later stage electrodes 8*b* and 8*d*), a quadrupole electric field can be formed between the linear quadrupolar electrodes a, b, c and d, a square well potential can be formed, and the target ions can be converged between the linear quadrupolar electrodes a, b, c and d. Furthermore, when the first DC voltage DC31 is superimposed between the linear quadrupolar electrodes a and c (front stage electrodes 7*a* and 7*c* and later stage electrodes 8*a* and 8*c*) and the linear quadrupolar electrodes b and d (front stage electrodes 7*b* and 7*d* and later stage electrodes 8*b* and 8*d*), the cleavage (collision induced dissociation) of the target ions can be carried out and fragment ions can be generated.

It has been described above that with the linear quadrupolar electrodes a, b, c and d, a quadrupole electric field is formed to form a square well potential, and the target ions and fragment ions can be converged in the square well potential. In addition, it has been described above that, with the linear quadrupolar electrodes a, b, c and d (front stage electrodes 7*a*, 7*b*, 7*c* and 7*d* and later stage electrodes 8*a*, 8*b*, 8*c* and 8*d*), fragment ions can be accelerated by the second DC voltage DC32 (acceleration voltage ΔU).

Next, when the fragment ions are accelerated with the second DC voltage DC32 (acceleration voltage ΔU), there are cases where a part of the fragment ions is lost (mass window becomes narrower).

First, depth D of a square well potential created in the quadrupole electric field by the linear quadrupolar electrodes a, b, c and d is expressed by Formula (1). Here, V is an amplitude of the AC voltage for collision RF3 to be applied to the linear quadrupolar electrodes a, b, c and d. In addition, q is a characteristic value showing a relation between the quadrupole electric field caused by the linear quadrupolar electrodes a, b, c and d and the mass of the molecule ions that are transmitted through the quadrupole electric field.

$$D = \frac{qV}{8} \qquad \text{Formula (1)}$$

This characteristic value q is expressed by Formula (2). Here, e is the elementary electric charge, m is the mass (mass number) of one molecule ion, w is angular frequency of the AC voltage for collision RF3, and $r_0$ is a radius of the inscribed circle of the linear quadrupolar electrodes a, b, c and d.

$$q = \frac{4eV}{mw^2 r_0^2} \quad \text{Formula (2)}$$

Figure 4:
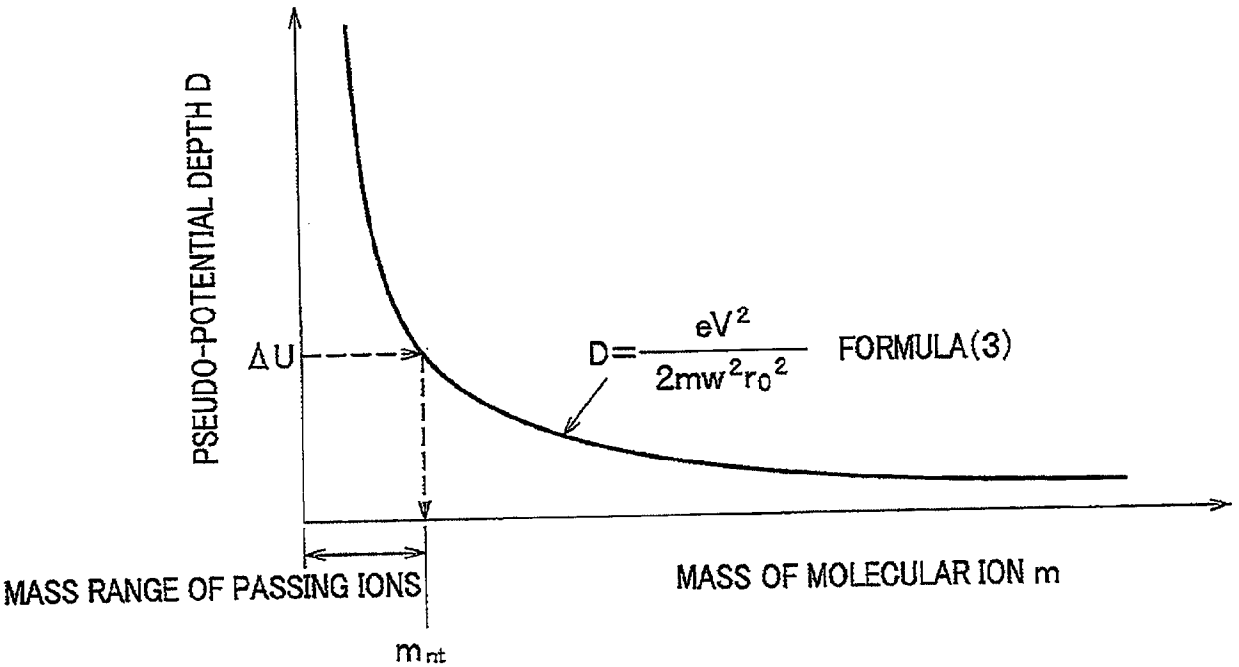
FIG. 4 is a graphic diagram showing a pseudo-potential depth corresponding to a mass of a molecule ion.

If Formula (2) is substituted for q (characteristic value) in Formula (1), it is possible to obtain Formula (3) that shows pseudo-potential depth D well assuming that the mass is m. From Formula (3), as shown in FIG. 4, square well potential depth (pseudo-potential depth) D has a relation of reverse proportion to the mass m of the molecule ion. The larger the mass m of the molecule ion is, the shallower the pseudo-potential depth D for the molecule ion having the mass m is.

$$D = \frac{eV^2}{2mw^2 r_0^2} \quad \text{Formula (3)}$$

In FIG. 4, when the acceleration voltage ΔU for accelerating the molecule ions in the axial direction is applied between the front stage electrodes 7*a*, 7*b*, 7*c* and 7*d* and the later stage electrodes 8*a*, 8*b*, 8*c* and 8*d* of the linear quadrupolar electrodes a, b, c and d, the voltage (acceleration voltage ΔU) having the same magnitude as the acceleration voltage ΔU is applied also to the orthogonal direction to the axial direction (The acceleration voltage ΔU is applied not only to the axial direction but also to the orthogonal direction to the axial direction). The molecule ions in which the acceleration voltage ΔU becomes smaller than the pseudo-potential depth D (ΔU<D) cannot exceed the pseudo-potential but can be transmitted between the linear quadrupolar electrodes a, b, c and d while maintaining the convergence. The molecule ions in which the acceleration voltage ΔU becomes smaller than the pseudo-potential depth D (ΔU<D) are molecule ions having mass m smaller than mass $m_{nt}$ ($m<m_{nt}$). It can be understood that, by applying the acceleration voltage ΔU, the molecule ions that can be transmitted are restricted to mass m smaller than mass $m_{nt}$, and the mass window becomes narrower.

Meanwhile, the molecule ions in which acceleration voltage ΔU is greater than or equal to the pseudo-potential depth D (ΔU≥D) exceed the pseudo-potential and collides with the linear quadrupolar electrodes a, b, c and d, to be lost. The molecule ions in which such acceleration voltage ΔU is greater than or equal to the pseudo-potential depth D (ΔU≥D) are molecule ions in which mass m is greater than or equal to mass $m_{nt}$ ($m \geq m_{nt}$) and the molecule ions are lost from one that has large mass m and cut upon the mass window being narrow.

It has been described above that there are cases where a part of the fragment ions is lost and the mass window becomes narrow when fragment ions are accelerated with the acceleration voltage ΔU (or second DC voltage DC32 (refer to FIG. 2A)). Next, a method for expanding the mass window will be described.

First, kinematic energy of the molecule ion of mass m caused by the moved electrical potential difference E is expressed by Formula (4). Here, v is a velocity of the molecule ions.

$$eE = \frac{1}{2}mv^2 \quad \text{Formula (4)}$$

When describing such Formula (4) for a case where the acceleration voltage ΔU is applied and fragment ions are accelerated between the front stage electrodes 7*a*, 7*b*, 7*c* and 7*d* and the later stage electrodes 8*a*, 8*b*, 8*c* and 8*d* of the linear quadrupolar electrodes a, b, c and d, Formula (4) is expressed as in Formula (5). Here, $m_f$ is mass of the fragment ion and $v_f$ is a velocity of the fragment ion inside the collision chamber 9.

$$e\Delta U = \frac{1}{2}m_f v_f^2 \quad \text{Formula (5)}$$

From Formula (5), assuming that the acceleration voltage ΔU is constant as in conventional techniques, when mass $m_f$ of the fragment ion changes according to the sample molecule to be measured, or the target ion or the fragment ion, the velocity $v_f$ for such fragment ion changes in proportion to the square root of $1/m_f$ (with correlation).

In contrast, the velocity $v_f$ of the fragment ion is constant in the present invention. In addition, the acceleration voltage ΔU is changed against the change in the mass $m_f$ of the fragment ion such that Formula (5) is met. Since the time for the fragment ion to be transmitted to the linear quadrupolar electrodes a, b, c and d can be set constant regardless of the mass $m_f$ of the fragment ion when the velocity $v_f$ of the fragment ion is constant, it is possible to easily determine the time when the fragment ion is introduced into the mass spectroscopy unit 11, and furthermore, the time the analysis in the mass spectroscopy unit 11 should be started.

Then, as shown in FIG. 4, since the mass $m_{nt}$ of the molecule ion in which the pseudo-potential depth D is equal to the acceleration voltage ΔU (D=ΔU) is the maximum mass $m_t$ in the mass window, it is possible to obtain Formula (6) showing a relation between the maximum mass $m_t$ and the mass $m_f$ of the fragment ion in the mass window when substituting Formula (3) and Formula (5) for Formula D=ΔU and deleting D and ΔU.

$$m_t = \frac{e^2 V^2}{w^2 r_0^2 v_f^2} \cdot \frac{1}{m_f} \quad \text{Formula (6)}$$

Meanwhile, the maximum mass $m_t$ in the mass window when the acceleration voltage ΔU is constant, which is in a conventional technique, is constant regardless of the mass $m_f$ of the fragment ion, and can be expressed by Formula (7).

$$m_t = \frac{eV}{2\Delta U w^2 r_0^2} \quad \text{Formula (7)}$$

In addition, since mass m of a case where the characteristic value q in Formula (2) is 0.908 (q=0.908), the minimum mass $m_c$ in the mass window is constant regardless of the mass $m_f$ of the fragment ion can be expressed by Formula (8).

$$m_c = \frac{4eV}{0.908w^2r_0^2} \quad \text{Formula (8)}$$

Figure 5:
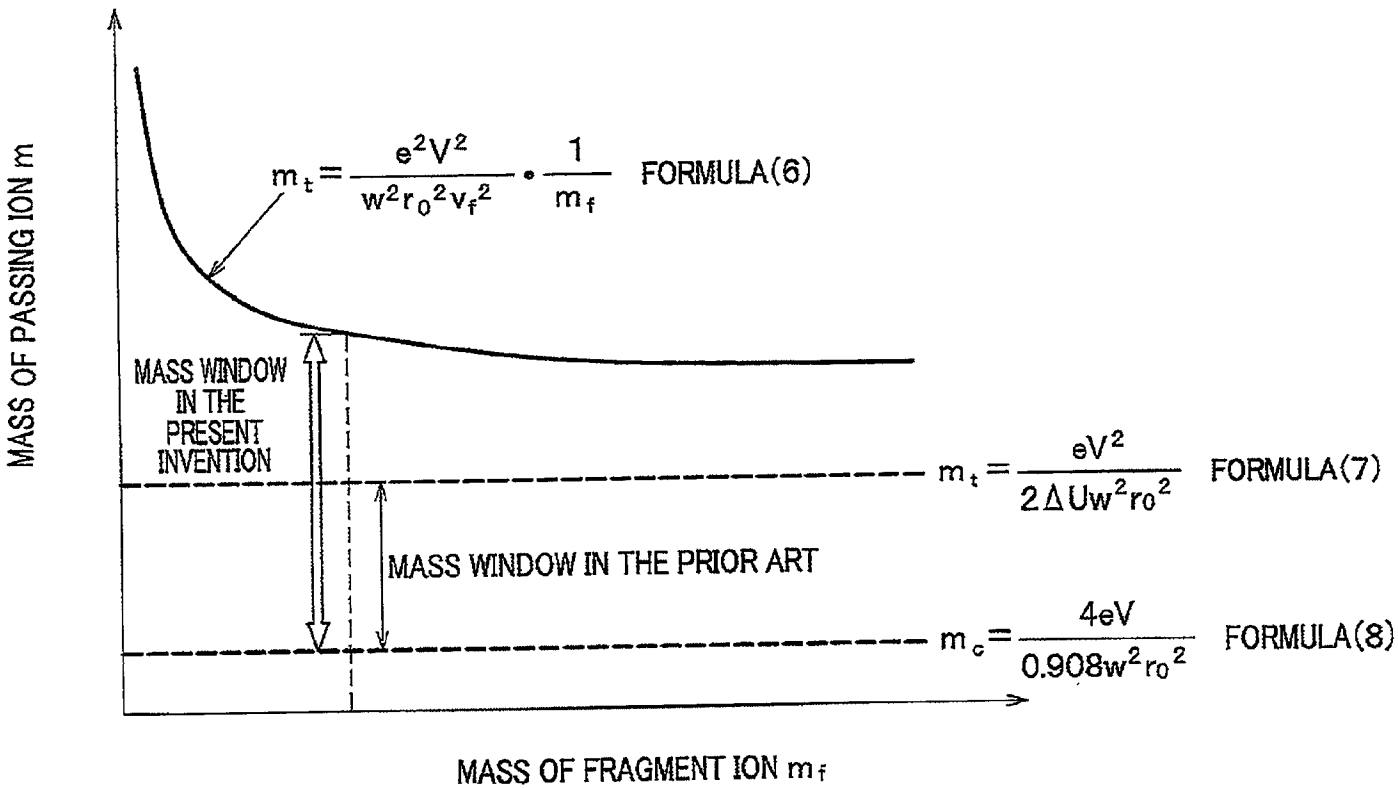
FIG. 5 is a graphic diagram showing a mass range of the fragment ions passing through the collision chamber, corresponding to the mass of the fragment ion (or mass window).

FIG. 5 shows the maximum mass $m_t$ in the present invention (Formula (6)) with a continuous line and the maximum mass m in a conventional technique (Formula (7)) and the minimum mass $m_c$ in Formula (8) with broken lines. Hence, the mass window of the present invention appears in the difference between the maximum mass $m_t$ of the present invention (Formula (6)) and the minimum mass $m_c$ in Formula (8), and the conventional mass window appears in the difference between the maximum mass $m_t$ in a conventional technique (Formula (7)) and the minimum mass $m_c$ in Formula (8). Accordingly, the maximum mass $m_t$ of the present invention (Formula (6)) is larger than the maximum mass $m_t$ in a conventional technique (Formula (7)) throughout the entire range of the mass $m_f$ of the fragment ion, and therefore it is possible to make the mass window of the present invention larger than the conventional mass window. In addition, the maximum mass $m_t$ of the present invention (Formula (6)) tends to become larger as the mass $m_f$ of the fragment ion is smaller, and the mass window of the present invention also tends to become wider as the mass $m_f$ of the fragment ion is smaller.

Figure 6A:
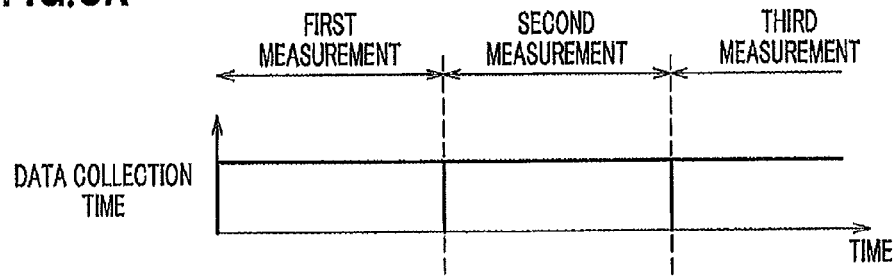
FIG. 6A is a graphic diagram (No. 1) showing change in a data collection time per each measurement.
Figure 6B:
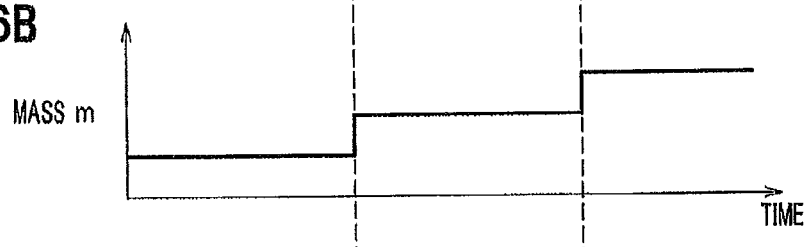
FIG. 6B is a graphic diagram (No. 1) showing change in a mass of a selected fragment ion per each measurement.
Figure 6C:
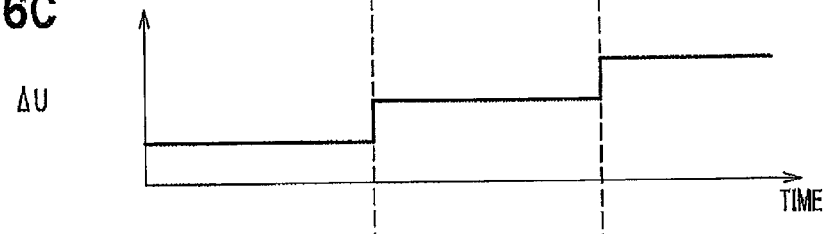
FIG. 6C is a graphic diagram (No. 1) showing change in a second DC voltage per each measurement.
Figure 6D:
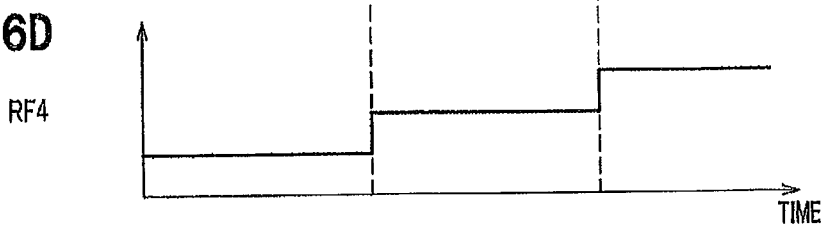
FIG. 6D is a graphic diagram (No. 1) showing change in an AC voltage for analysis per each measurement.

FIG. 6A is a graphic diagram showing that data collection in the measurement is repeated three times in a mass spectrometry method of the present invention. As shown in FIG. 6B, in the first measurement, the control unit 14 determines the mass m ($m_f$) of the fragment ion based on the mass-to-charge ratio of the fragment ion, which is input by the operator. Then, the control unit 14 determines the acceleration voltage ΔU as shown in FIG. 6C. The acceleration voltage ΔU is calculated and determined based on the mass m ($m_f$) of the fragment ion and the velocity $v_f$ of the fragment ion having a constant value using Formula (5). It should be noted that the control unit 14 determines the AC voltage for analysis RF4 or the DC voltage for analysis DC4 as shown in FIG. 6D. The AC voltage for analysis RF4 and the DC voltage for analysis DC4 can be determined such that the fragment ion of the determined mass m ($m_f$) is selected in the mass spectroscopy unit 11 and detected by the detector 13.

As shown in FIG. 6B, the second measurement shows a case where the mass m ($m_f$) having a larger fragment ion than the first measurement is determined by the control unit 14. In addition, the third measurement shows a case where the mass m ($m_f$) of further larger fragment ion than the second measurement is determined by the control unit 14. Consequently, as shown in FIG. 6C, the control unit 14 determines larger acceleration voltage ΔU than the first measurement in the second measurement. In addition, in the third measurement, further larger acceleration voltage ΔU than the second measurement is determined by the control unit 14. By determining in this way, the velocity $v_f$ of the fragment ion can be constant. In addition, as shown in FIG. 6D, in the second measurement, the AC voltage for analysis RF4 and the DC voltage for analysis DC4 larger than the first measurement are determined by the control unit 14. In addition, in the third measurement, the AC voltage for analysis RF4 and the DC voltage for analysis DC4 further larger than the second measurement are determined by the control unit 14. By determining in this way, in the mass spectroscopy unit 11, the fragment ion having the determined mass m ($m_f$) is selected and is detected by the detector 13.

Next, a case where the mass spectrum is acquired will be described.

Figure 7A:
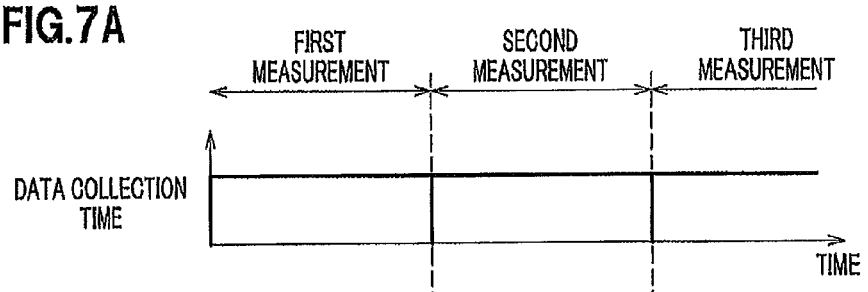
FIG. 7A is a graphic diagram (No. 2) showing change in a data collection time per each measurement.
Figure 7B:
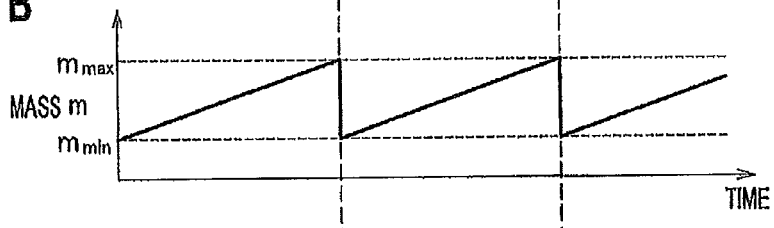
FIG. 7B is a graphic diagram (No. 2) showing change in a mass of a selected fragment ion per each measurement.
Figure 7C:
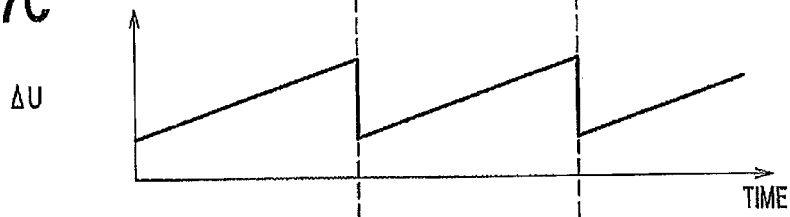
FIG. 7C is a graphic diagram (No. 2) showing change in a second DC voltage per each measurement.

As shown in FIGS. 7A and 7B, the control unit 14 carries out the scan of the mass m ($m_f$) of the fragment ion for each measurement from the minimum mass $m_{min}$ that is set in advance as a test range to the maximum mass $m_{max}$. According to the mass m ($m_f$) of the fragment ion in each time of the scan, the control unit 14 determines the acceleration voltage ΔU as shown in FIG. 7C. Using Formula (5), the acceleration voltage ΔU is calculated based on the mass m ($m_f$) of the fragment ion that is scanned and changed point by point and the velocity $v_f$ of the fragment ion having a constant value and is determined at each time. Hence, the acceleration voltage ΔU changes as if the setting range is scanned from the minimum to the maximum.

Figure 7D:
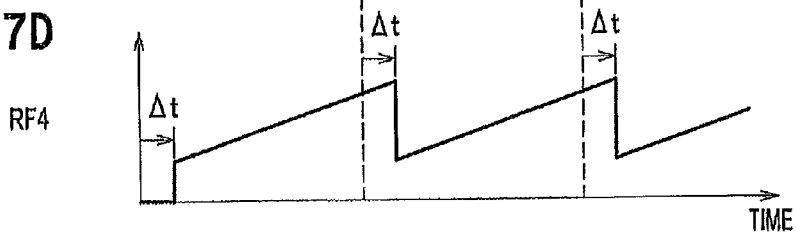
FIG. 7D is a graphic diagram (No. 2) showing change in an AC voltage for analysis per each measurement.

It should be noted that the control unit 14 also determines the AC voltage for analysis RF4 and the DC voltage for analysis DC4 as shown in FIG. 7D. The AC voltage for analysis RF4 and the DC voltage for analysis DC4 are determined such that the fragment ion having mass m ($m_f$) that is scanned and determined at each time is selected in the mass spectroscopy unit 11 and is detected by the detector 13. Hence, the AC voltage for analysis RF4 and the DC voltage for analysis DC4 change as if the setting range is scanned from the minimum to the maximum. In addition, the control unit 14 starts the scan of the AC voltage for analysis RF4 and the DC voltage for analysis DC4 after elapsing a time of Δt that is needed for the fragment ion to undergo the transmission of the collision chamber 9 (linear quadrupolar electrodes a, b, c and d) from the start of the scan of acceleration voltage ΔU (second DC voltage DC32). Hence, it is possible to obtain mass spectrum having high S/N ratio. It should be noted that such method of starting is not limited to the case involving a scan but may be performed at the start of the AC voltage for analysis RF4 in FIG. 6D and the DC voltage for analysis DC4.

Second Embodiment

FIG. 8A is a block diagram showing the mass spectrometer 100 according to the second embodiment of the present invention; and FIG. 8B is a graphic diagram showing electrical potential along the axial direction of the mass spectrometer 100. The mass spectrometer 100 of the second embodiment is different from the mass spectrometer 100 of the first embodiment in that the former includes the synchronizing unit 15. The synchronizing unit 15 synchronizes the AC voltage for collision RF3 of the AC power source for collision RF3 with the AC voltage for analysis RF4 of the AC power source for analysis RF4 and makes the voltages have the same electrical potential difference.

Although the fourth stage quadrupole (fourth stage linear quadrupolar electrode) 12 performs mass separation of the fragment ion, since a quadrupole mass spectrometer (linear quadrupolar electrode) generally operates with the characteristic value q of 0.706 (q=0.706), the relation between the mass $m_f$ of the fragment ion and the amplitude V' of the AC voltage for analysis RF4 are shown by the following Formula (9) from Formula (2).

$$V' = \frac{0.706w^2r_0^2}{4e} \cdot m_f \quad \text{Formula (9)}$$

At this time, pseudo-potential depth D' is expressed by the following Formula (10) by substituting Formula (9) for Formula (3).

$$D' = \frac{(0.702)^2 w^2 r_0^2}{32e \cdot m} \cdot m_f^2 \quad \text{Formula (10)}$$

Here, since the AC voltage for collision RF3 and the AC voltage for analysis RF4 synchronize with each other and have the same electrical potential difference in the second embodiment, the amplitude V of the AC voltage for collision RF3 and the amplitude V' of the AC voltage for analysis RF4 are the same (V'=V). For this reason, the pseudo-potential depth D' generated by the AC voltage for analysis RF4 is equal to the pseudo-potential depth D generated by the AC voltage for collision RF3 (D'=D). As described above in relation to the first embodiment, when the pseudo-potential depth D is equal to the acceleration voltage ΔU (D=ΔU), the mass $m_f$ of the fragment ion is the maximum mass $m_t$ in the mass window, and further, in the second embodiment, the pseudo-potential depth D' is equal to the pseudo-potential depth D (D'=D). Therefore, when the pseudo-potential depth D' is equal to the acceleration voltage ΔU (D'=ΔU), the mass $m_f$ of the fragment ion is the maximum mass $m_t$ ($m_t'$) in the mass window. When substituting Formula (5) and Formula (10) for Formula D'=ΔU and deleting D' and ΔU, it is possible to obtain Formula (11) showing a relation between the maximum mass $m_t'$ in the mass window and the mass $m_f$ of the fragment ion.

$$m_t' = \frac{(0.706)^2 w^2 r_0^2}{16 v_f^2} \cdot m_f \quad \text{Formula (11)}$$

Figure 9:
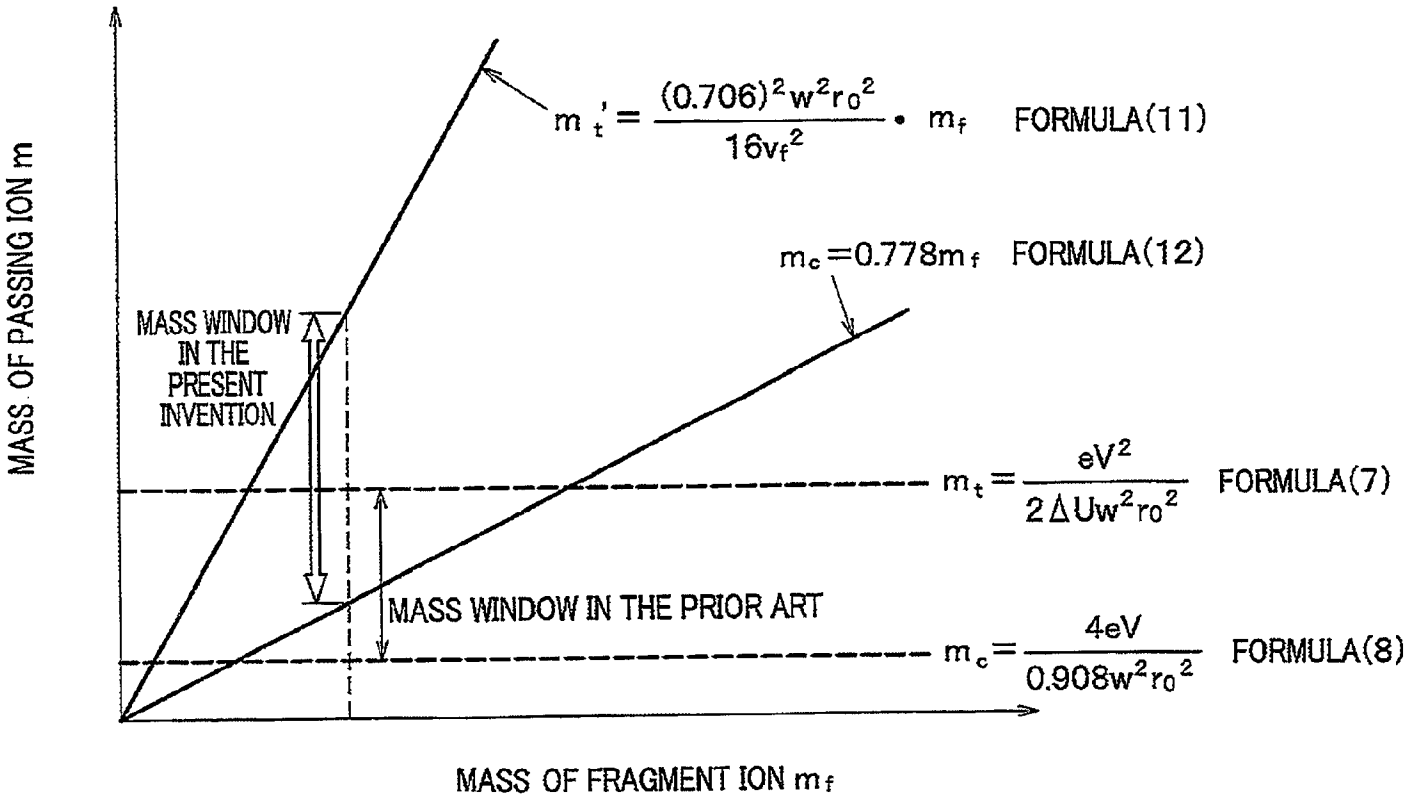
FIG. 9 is a graphic diagram showing a mass range of the fragment ions passing through the collision chamber, corresponding to the mass of the fragment ion (or mass window).

As shown in FIG. 9, Formula (11) shows that the maximum mass $m_t'$ is proportional to the mass $m_f$ of the fragment ion. Meanwhile, since the amplitude V' of the AC voltage for analysis RF4 is also proportional to the mass $m_f$ of the fragment ion from Formula (9), the minimum mass $m_c'$ is also proportional to the mass $m_f$ of the fragment ion. That is, the characteristic value q in Formula (2) is set to 0.908 (q=0.908), and the AC voltage for collision RF3 and the AC voltage for analysis RF4 synchronize with each other and have the same electrical potential difference, and the amplitude V of the AC voltage for collision RF3 and the amplitude V' of the AC voltage for analysis RF4 are equal (V'=V) in the second embodiment. Therefore, when substituting V' in Formula (9) for V in Formula (2) and deleting V and V', it is possible to obtain Formula (12) showing a relation between the minimum mass $m_c'$ in the mass window and the mass $m_f$ of the fragment ion.

$$m_c' = \frac{0.706}{0.908} \cdot m_f \cong 0.778 m_f \quad \text{Formula (12)}$$

FIG. 9 shows the maximum mass $m_t'$ in the present invention (Formula (11)) and the minimum mass $m_c'$ in the present invention (Formula (12)) in continuous lines and the maximum mass $m_t$ (Formula (7)) and the minimum mass $m_c$ in Formula (8) in a conventional technique in broken lines. The mass window of the present invention appears in the difference between the maximum mass $m_t'$ of the present invention (Formula (11)) and the minimum mass $m_c'$ of the present invention (Formula (12)), and the conventional mass window appears in the difference between the maximum mass $m_t$ (Formula (7)) and the minimum mass $m_c$ in Formula (8) in a conventional technique. Hence, the range is throughout the mass $m_f$ of the fragment ion, the maximum mass $m_t'$ in Formula (11) is larger than the mass $m_f$ of the fragment ion ($m_t'>m_f$), and the minimum mass $m_c'$ in Formula (12) is smaller than the mass $m_f$ of the fragment ion ($m_c'<m_f$). Therefore, it is possible to measure a fragment ion having mass $m_f$ of any size. In addition, the mass window of the present invention tends to become wider as the mass $m_f$ of the fragment ion is larger.

Figures 10A, 10B, 10C, 10D, 10E:
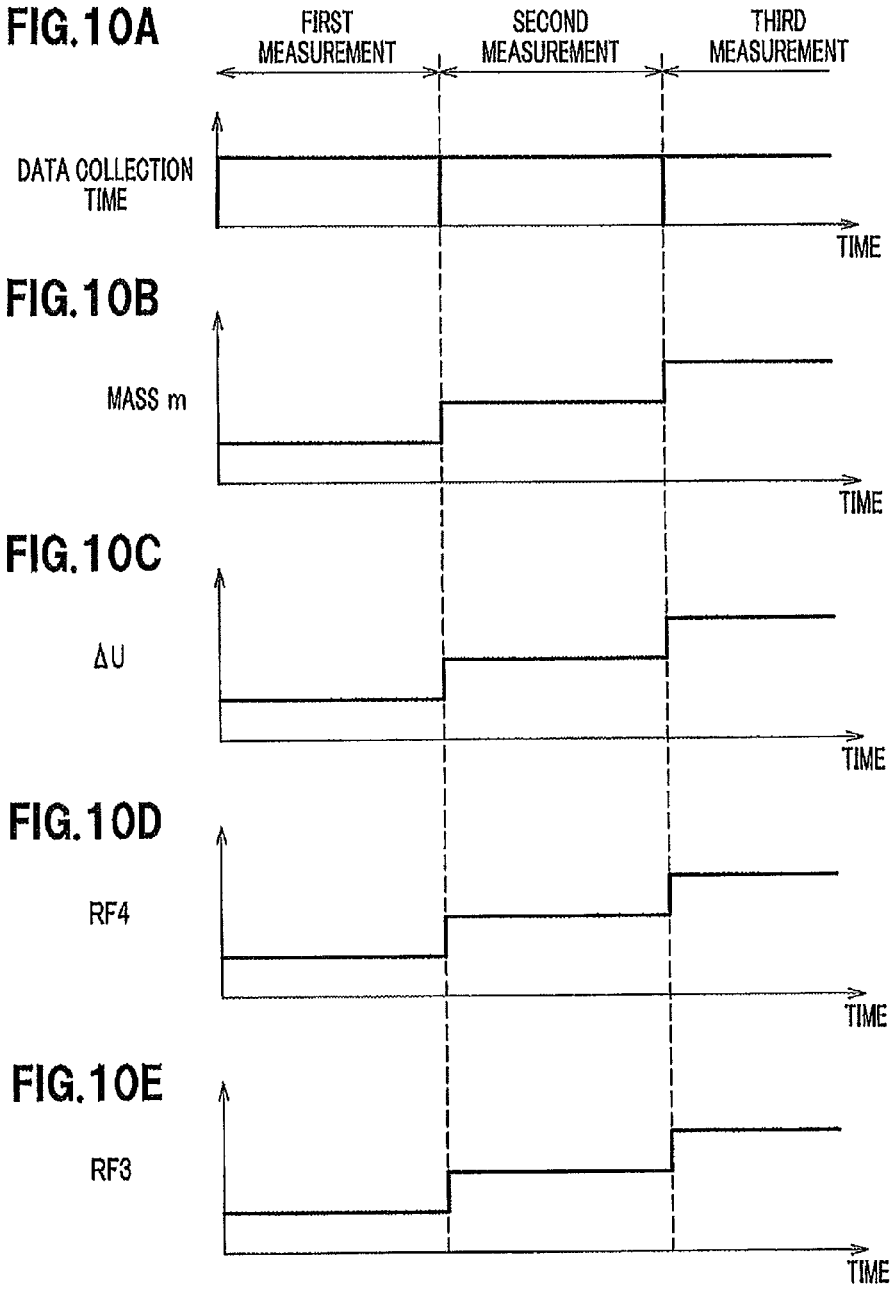
FIG. 10A is a graphic diagram (No. 1) showing change in a data collection time per each measurement.
FIG. 10B is a graphic diagram (No. 1) showing change in a mass of a selected fragment ion per each measurement.
FIG. 10C is a graphic diagram (No. 1) showing change in a second DC voltage per each measurement.
FIG. 10D is a graphic diagram (No. 1) showing change in an AC voltage for analysis per each measurement.
FIG. 10E is a graphic diagram (No. 1) showing change in an AC voltage for collision per each measurement.

FIG. 10A is a graphic diagram showing a case in which the data collection in the measurement is repeated three times in the mass spectrometry method in the second embodiment the present invention. The mass spectrometry method of the second embodiment is different from the mass spectrometry method of the first embodiment (refer to FIGS. 6A-6D) in that the former synchronizes the AC voltage for collision RF3 with the AC voltage for analysis RF4 and makes both voltages have the same electrical potential difference as shown in FIGS. 10D and 10E. When a larger AC voltage for analysis RF4 is determined by the control unit 14 in the second measurement than an AC voltage for analysis in the first measurement, and further a larger AC voltage for analysis RF4 is determined by the control unit 14 in the third measurement than an AC voltage for analysis in the second measurement, the AC voltage for collision RF3 is set to have the same electrical potential difference as the AC voltage for analysis RF4. Then, the second measurement is set larger than the first measurement, and the third measurement is set further larger than the second measurement. By setting in this way, as described in relation to FIG. 9, a mass window can be provided which reliably includes the mass m ($m_f$) thus determined.

Figure 11A:
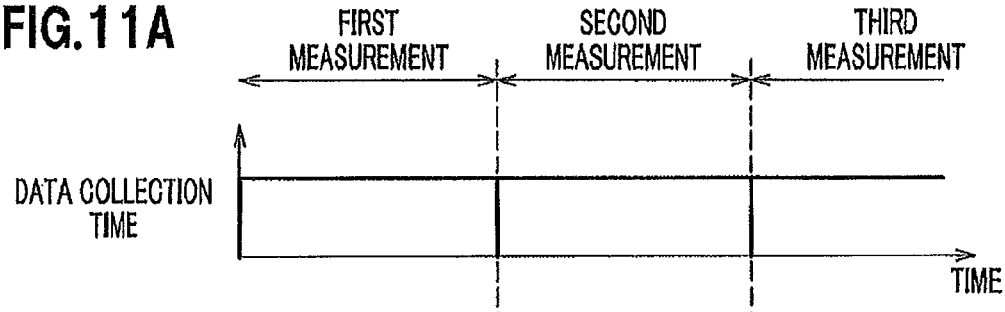
FIG. 11A is a graphic diagram (No. 2) showing change in a data collection time per each measurement.
Figure 11B:
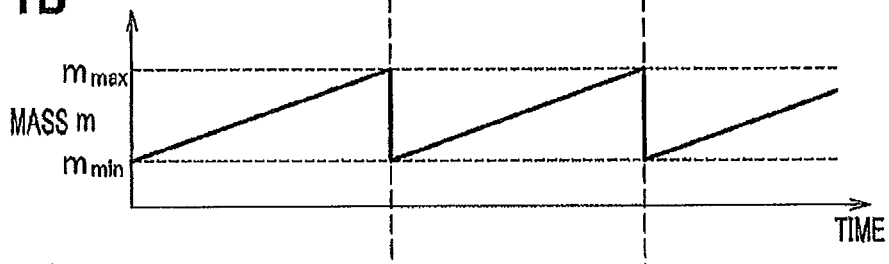
FIG. 11B is a graphic diagram (No. 2) showing change in a mass of a selected fragment ion per each measurement.
Figure 11C:
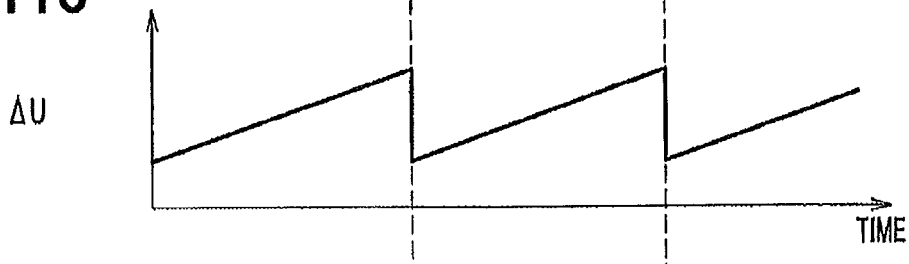
FIG. 11C is a graphic diagram (No. 2) showing change in a second DC voltage per each measurement.
Figure 11D:
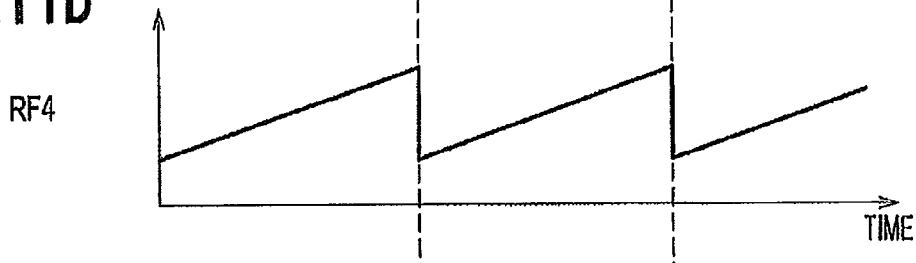
FIG. 11D is a graphic diagram (No. 2) showing change in an AC voltage for analysis per each measurement.
Figure 11E:
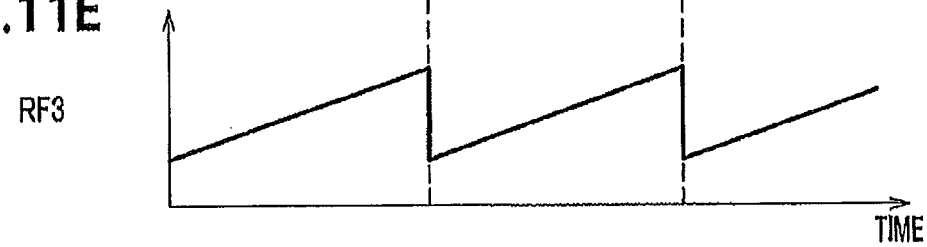
FIG. 11E is a graphic diagram (No. 2) showing change in an AC voltage for collision per each measurement.

Next, the case where the mass spectrum is acquired will be described. The mass spectrometry method (method for acquiring the mass spectrum) of the second embodiment is different from the mass spectrometry method (or method for acquiring the mass spectrum; refer to FIGS. 7A-7D) of the first embodiment in that, as shown in FIGS. 11D and 11E, the former scans the AC voltage for collision RF3 so as to synchronize with and have the same electrical potential difference as the AC voltage for analysis RF4. As shown in FIGS. 11B and 11D, the control unit 14 determines the AC power source for analysis RF4 such that the fragment ion of mass m ($m_f$) that is scanned and determined point by point is selected in the mass spectroscopy unit 11 and detected by the detector 13. Hence, the AC voltage for analysis RF4 changes as if the setting range is scanned from the minimum to the maximum. Then, the AC voltage for collision RF3 changes point by point so as to have the same electrical potential difference as the AC voltage for analysis RF4. As a result, the AC voltage for collision RF3 changes as if the setting range is scanned from the minimum to the maximum.

Third Embodiment

Figure 12:
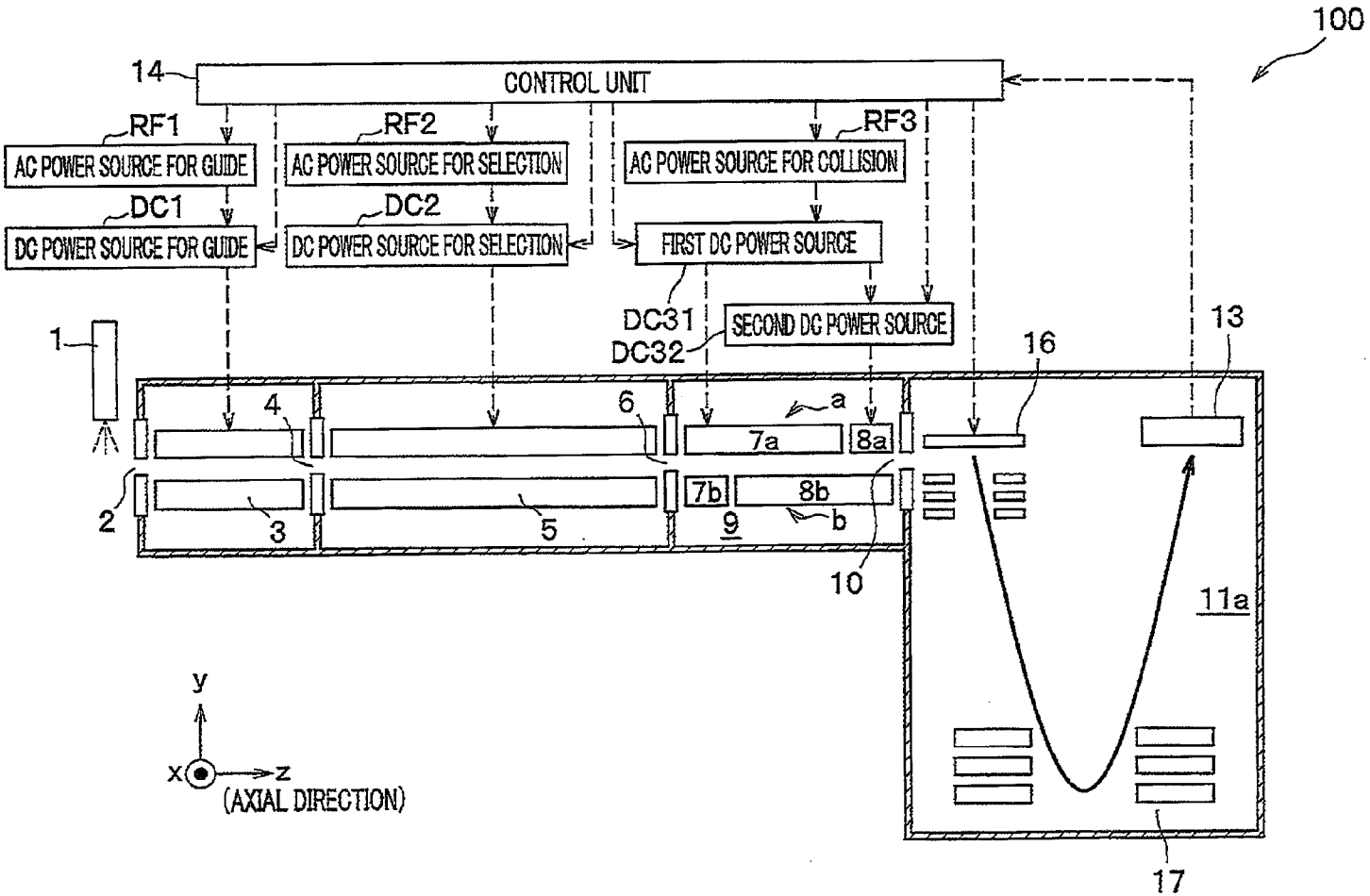
FIG. 12 is a block diagram showing a control unit and power sources of the mass spectrometer according to a third embodiment of the present invention.

FIG. 12 is a block diagram showing the mass spectrometer 100 according to the third embodiment of the present invention. The mass spectrometer 100 of the third embodiment is different from the mass spectrometer 100 of the first embodiment in that the former uses a time-of-flight mass spectrometer (TOFMS) for the mass spectroscopy unit 11*a* of the second embodiment instead of the mass spectroscopy unit (quadrupole the characteristic amount analyzer) 11 of the first embodiment.

The mass spectroscopy unit 11*a* of the time-of-flight mass spectrometer includes: an acceleration stack 16 which accelerates the fragment ion; a reflecting electrode 17 which makes kinematic energy for each fragment ion uniform; and a detector 13 which detects the fragment ion and changes the fragment ion into a current value. In this third embodiment, although a direct acceleration reflective type time-of-flight mass spectrometer is used as an example, the present invention can also be used in methods that arrange a detector in the direction of movement of the fragment ion without using a method that accelerates in the axial direction or the reflecting electrode 17.

The mass spectroscopy unit 11*a* of the time-of-flight mass spectrometer performs mass separation by accelerating the fragment ion with an electric field generated in the acceleration stack 16 and measuring the time to reach the detector 13. The acceleration energy given to the fragment ion by such an electric field is constant regardless of the mass-to-charge ratio (mass $m_f$) of the fragment ion, and therefore the time to reach the detector 13 is different depending on the mass-to-charge ratio ($m_f$). That is, the smaller the mass-to-charge ratio ($m_f$) is, the faster the fragment ion is, and the larger the mass-to-charge ratio ($m_f$) is, the later the fragment arrives at the detector 13. The arrival time corresponds to the mass-to-charge ratio ($m_f$) one by one, and when the current value outputted from the detector 13 for each arrival time is acquired and plotted, it is possible to obtain the mass spectrum. Due to having high mass resolution and high mass precision, the time-of-flight mass spectrometer has high qualitative determination capability.

In addition, the mass spectrometer 100 of the third embodiment is a device that combines the selection unit (second stage quadrupole (second stage linear quadrupolar electrode)) 5 and the mass spectroscopy unit 11*a* of the time-of-flight mass spectrometer, and is provided the collision chamber 9 between the selection unit 5 and the mass spectroscopy unit 11*a*. Hence, it is possible to perform the MS/MS analysis that conducts one or more of the ion selection and collision induced dissociation. A mass spectrometer that can perform MS/MS analysis is called a tandem MS. Examples of the tandem MS include a quadrupole-time-of-flight mass spectrometer (Q-TOF) such as the mass spectrometer 100 of the third embodiment, a triple quadrupolar mass spectrometer (Triple QMS) such as the mass spectrometer 100 of the first embodiment, and furthermore, an ion trap mass spectrometer. In the mass spectrometer 100 of the first embodiment, the ion trap mass spectrometers also serves as the second stage linear quadrupolar electrode in the selection unit 5 and the fourth stage linear quadrupolar electrode 12 in the mass spectroscopy unit 11 with the third stage linear quadrupolar electrode a, b, c and d in the collision chamber 9, and makes the Collision Energy into the electrical potential difference between the electrical potential of the pore 6 and the first DC voltage DC31. In addition, the measurement using the mass spectrometry method of the present invention can also be performed with the quadrupole-time-of-flight mass spectrometer (Q-TOF) of the third embodiment, the triple quadrupole mass spectrometer (Triple QMS) of the first embodiment and the ion trap mass spectrometer.

Figure 13A:
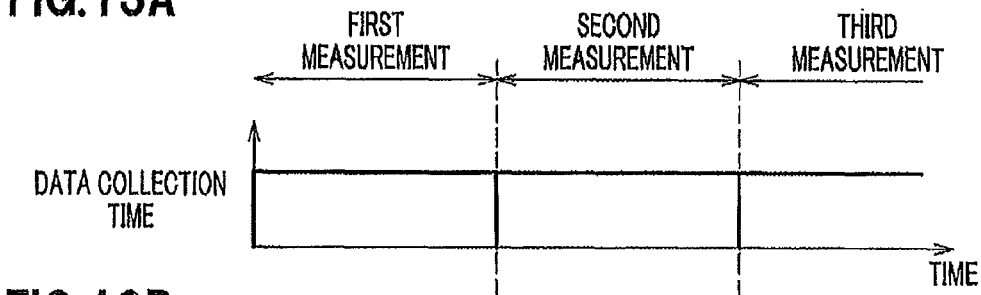
FIG. 13A is a graphic diagram showing change in a data collection time per each measurement.
Figure 13B:
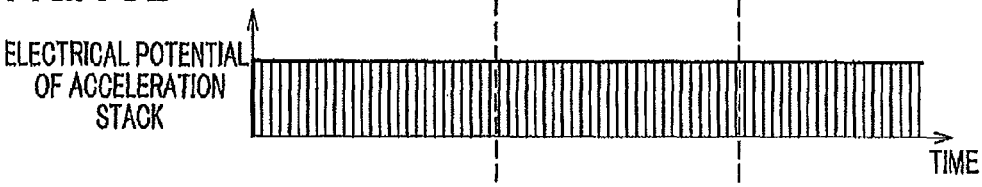
FIG. 13B is a graphic diagram showing change in electrical potential of an acceleration stack per each measurement.

Referring now to FIGS. 13A-13E, a case where mass spectrum is acquired in the measurement by the mass spectrometry method of the third embodiment in the present invention will be described. The mass spectrometry method of the third embodiment (method for acquiring the mass spectrum) is different from the mass spectrometry method of the second embodiment (method for acquiring the mass spectrum; refer to FIGS. 11A-11E) in that the former does not have an AC voltage for analysis RF4 as shown in FIG. 11D since the AC power source for analysis RF4 is not necessary. Meanwhile, as shown in FIG. 13B, the control unit 14 applies pulse form voltage to the acceleration stack (accelerating electrode) 16. Whenever the pulse form voltage is applied, the fragment ion is accelerated and the control unit 14 starts the measurement of the arrival time.

Figure 13C:
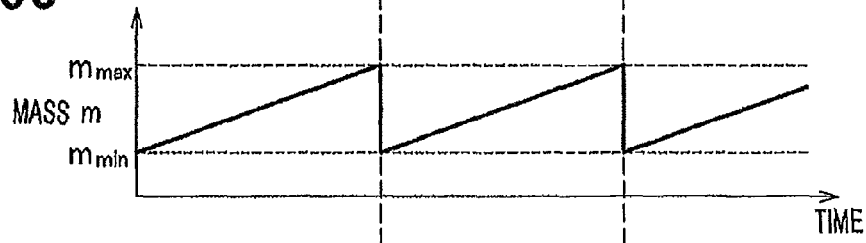
FIG. 13C is a graphic diagram showing change in a mass of a selected fragment ion per each measurement.
Figure 13D:
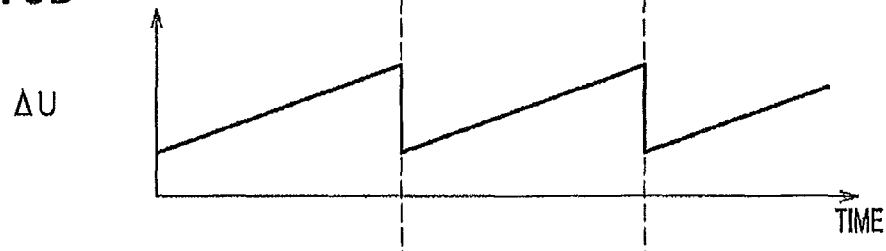
FIG. 13D is a graphic diagram showing change in a second DC voltage per each measurement.

Since the velocity $V_f$ of the fragment ion is set constant and the mass spectroscopy unit 11*a* is a time-of-flight mass spectrometer in the third embodiment also, with the same method as the first and the second embodiment, the measurement mass range is scanned at the intervals of the data collection time for each measurement such that the mass m of the fragment ion is as shown in FIG. 13C. Specifically, the control unit 14 performs voltage operation of the acceleration voltage ΔU (second DC voltage DC32) as shown in FIG. 13D. Hence, it is possible to obtain the same effect as the first embodiment.

Figure 13E:
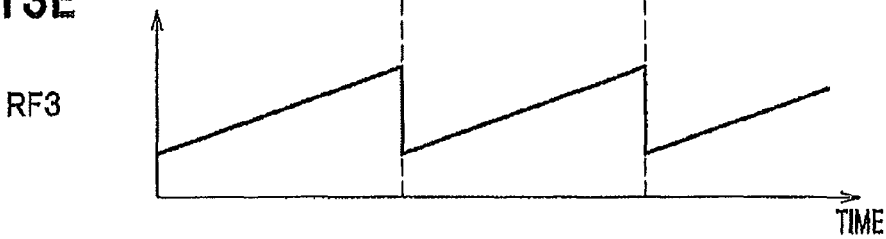
FIG. 13E is a graphic diagram showing change in an AC voltage for collision per each measurement.

In addition, as shown in FIG. 13E, it is possible to obtain the same effect as the second embodiment as in FIG. 11E by scanning the AC voltage for collision RF3 or the first DC voltage DC31. However, since the AC power source for analysis RF4 does not exist in the third embodiment, the AC voltage for collision RF3 cannot be synchronized with the AC voltage for analysis RF4. Accordingly, the synchronization is carried out with the acceleration voltage ΔU (second DC voltage DC32).

DESCRIPTION OF THE REFERENCE NUMERALS

1 ion source unit
2 pore
3 ion guide unit (first stage quadrupole (first stage linear quadrupolar electrode))
4 pore
5 selection unit (second stage quadrupole (second stage linear quadrupolar electrode))
6 pore
7*b*, 7*c*, 7*d* front stage electrode of third stage linear quadrupolar electrode
8*b*, 8*c*, 8*d* rear stage electrode of third stage linear quadrupolar electrode
9 collision chamber
10 pore
11 mass spectroscopy unit (quadrupolar mass spectrometer)
11*a* mass spectroscopy unit (time-of-flight mass spectrometer)
12 fourth stage quadrupole (fourth stage linear quadrupolar electrode)
13 detecting unit
14 control unit
15 synchronizing unit
16 accelerating electrode
17 reflecting electrode
100 mass spectroscope
a, b, c, d linear multipolar electrode (third stage linear quadrupolar electrode)
DC1 DC power source for guide (DC voltage for guide)
DC2 DC power source for selection (DC voltage for selection)
DC31 first DC power source (first DC voltage)
DC32 second DC power source (second DC voltage ΔU: acceleration voltage)
DC4 analysis DC power source (DC voltage for analysis)
RF1 AC power source for guide (AC voltage for guide)
RF2 AC power source for selection (AC voltage for selection)
RF3 AC power source for collision (AC voltage for collision)
RF4 AC power source for analysis (AC voltage for analysis)
ΔU second DC voltage

The invention claimed is:

1. A mass spectrometer comprising:

a collision chamber including linear multipolar electrodes, and accelerating fragment ions in a direction along the linear multipolar electrodes by superimposingly applying an AC voltage for collision and a first DC voltage between the linear multipolar electrodes, having a molecule ion collide with a neutral molecule to cause collision induced dissociation of the molecule ion and to generate the fragment ions, and applying a second DC voltage between a front stage electrode and a later stage electrode which are divided from each linear multipolar electrode;

a mass spectroscopy unit carrying out mass separation of the fragment ions with mass-to-charge ratios, the fragment ions accelerated in the collision chamber; and a control unit configured to determine the second DC voltage based on the mass-to-charge ratios of the fragment ions to be selected in the mass spectroscopy unit such that velocities of the fragment ions in the collision chamber become equal regardless of the mass-to-charge ratios of the fragment ions.

2. The mass spectrometer according to claim 1, wherein the control unit is configured to increase the second DC voltage as the mass-to-charge ratios selected in the mass spectroscopy unit become larger.

3. The mass spectrometer according to claim 1, further comprising an upper limit for the mass-to-charge ratios of the fragment ions in the mass separation, wherein the upper limit is set smaller as the mass-to-charge ratios selected in the mass spectroscopy unit become larger, the mass separation being carried out in the mass spectroscopy unit after the fragment ions pass through the collision chamber.

4. The mass spectrometer according to claim 1, wherein the control unit is configured to determined at least one of the AC voltage for collision and the first DC voltage based on the mass-to-charge ratios of the fragment ions selected in the mass spectroscopy unit such that the selected fragment ions are transmitted inside the collision chamber.

5. The mass spectrometer according to claim 1, further comprising another multipolar electrode for analysis to which an AC voltage for analysis and a DC voltage for analysis are applied in the mass spectroscopy unit so as to carry out the mass separation of the fragment ions based on the mass-to-charge ratios, wherein the control unit is configured to start application of at least one of the AC voltage for analysis and the DC voltage for analysis after a predetermined time necessary for the fragment ions to pass through the collision chamber is passed from a start time of applying the second DC voltage.

6. The mass spectrometer according to claim 1, further comprising another multipolar electrode for analysis to which an AC voltage for analysis and a DC voltage for analysis are applied in the mass spectroscopy unit so as to carry out the mass separation of the fragment ions based on the mass-to-charge ratios of the fragment ions, wherein the control unit is configured to synchronize the AC voltage for collision with the AC voltage for analysis such that both voltages have the same electrical potential difference.

7. The mass spectrometer according to claim 6, further comprising an upper limit for the mass-to-charge ratios of the fragment ions in the mass separation, wherein the upper limit is set larger as the mass-to-charge ratios selected in the mass spectroscopy unit are larger, the mass separation being carried out in the mass spectroscopy unit after the fragment ions pass through the collision chamber.

8. The mass spectrometer according to claim 7, further comprising a lower limit for the mass-to-charge ratios of the fragment ions passing through the collision chamber in the mass separation carried out in the mass spectroscopy unit, wherein the lower limit is set larger as the mass-to-charge ratios of the fragment ions selected in the mass analysis unit become larger, at a smaller rate than a rate of the upper limit which becomes larger in the mass separation.

9. The mass spectrometer according to claim 1, wherein the control unit is configured to:

scan the mass-to-charge ratios of the fragment ions to be selected;

scan the second DC voltage by synchronizing with a scan of the mass-to-charge ratios of the fragment ions to be selected in the mass spectroscopy unit such that velocities of the fragment ions in the collision chamber become equal regardless of the mass-to-charge ratios of the fragment ions; and calculate an amount of the fragment ions that are subjected to the mass separation for each mass-to-charge ratio.

10. The mass spectrometer according to claim 9, wherein the control unit is configured to scans at least one of the AC voltage for collision and the first DC voltage by synchronizing with the mass-to-charge ratios of the fragment ions to be selected in the mass spectroscopy unit or the scan of the second DC voltage such that the selected fragment ions pass through inside the collision chamber based on the mass-to-charge ratios of the fragment ions to be selected in the mass spectroscopy unit.

11. The mass spectrometer according to claim 9, wherein the mass spectroscopy unit includes another multipolar electrode for analysis to which an AC voltage for analysis and a DC voltage for analysis are applied so as to carry out the mass separation of the fragment ions based on the mass-to-charge ratios of the fragment ions; and the control unit is configured to start a scan of at least one of the AC voltage for analysis and the DC voltage for analysis after a predetermined time necessary for the fragment ions to pass through the collision chamber is passed from a start time of scanning the second DC voltage.

12. The mass spectrometer according to claim 9, wherein the mass spectroscopy unit includes another multipolar electrode for analysis to which an AC voltage for analysis and a DC voltage for analysis are applied so as to carry out the mass separation of the fragment ions based on the mass-to-charge ratios of the fragment ions; and the control unit is configured to scan the AC voltage for collision by synchronizing with a scan of the AC voltage for analysis at the same electrical potential.

13. The mass spectrometer according to claim 9, wherein the mass spectroscopy unit is a time-of-flight mass spectrometer.

14. The mass spectrometer according to claim 1, further comprising a selection unit of selecting a molecule ion having a specific mass-to-charge ratio from introduced molecule ions so as to supply the selected molecule ion into the collision chamber, wherein the control unit is configured to set the specific mass-to-charge ratio.

15. The mass spectrometer according to claim 14, further comprising an ion source unit of ionizing sample molecules so as to generate the molecule ions; and an ion guide unit of transporting the molecule ions to the selection unit.

16. The mass spectrometer according to claim 14, wherein the collision chamber serves also as at least one of the selection unit and the mass spectroscopy unit.

17. The mass spectrometer according to claim 1, wherein a division ratio between the front stage electrode and the later stage electrode, which are divided per each linear multipolar electrode in the collision chamber, is different per each linear multipolar electrode.

18. The mass spectrometer according to claim 1, wherein a divided position between the front stage electrode and the later stage electrode, which are divided per each linear multipolar electrode in the collision chamber, is different per each linear multipolar electrode in a direction along the linear multipolar electrode.

19. A mass spectrometry method, comprising the steps of:

generating fragment ions in a collision chamber by superimposingly applying an AC voltage for collision and a first DC voltage between linear multipolar electrodes, by making molecule ions collide with neutral molecules to carry out collision induced dissociation of the molecule ions;

accelerating the fragment ions in a direction along the linear multipolar electrodes by applying a second DC voltage between a front stage electrode and a later stage electrode, which are divided per each linear multipolar electrode in the collision chamber; and carrying out mass separation of the fragment ions accelerated in the collision chamber based on mass-to-charge ratios of the fragment ions in the mass spectroscopy unit; wherein the second DC voltage is determined based on the mass-to-charge ratios of the fragment ions to be selected in the mass spectroscopy unit such that velocities of the fragment ions in the collision chamber become equal regardless of the mass-to-charge ratios of the fragment ions.

20. The mass spectrometry method according to claim 19, wherein the second DC voltage is set larger as the mass-to-charge ratios of the fragment ions to be selected in the mass spectroscopy unit are set larger.

* * * * *